US011348542B2

(12) United States Patent
Ma et al.

(10) Patent No.: US 11,348,542 B2
(45) Date of Patent: May 31, 2022

(54) DRIVING METHOD FOR DISPLAY DEVICE AND DISPLAY DEVICE

(71) Applicant: Shanghai Tianma Micro-Electronics Co.,Ltd., Shanghai (CN)

(72) Inventors: Conghua Ma, Shanghai (CN); Lihua Wang, Shanghai (CN); Xiaoping Sun, Shanghai (CN); Qiang Dong, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 16/944,095

(22) Filed: Jul. 30, 2020

(65) Prior Publication Data

US 2021/0375219 A1 Dec. 2, 2021

(30) Foreign Application Priority Data

May 29, 2020 (CN) ..... 202010472858.3

(51) Int. Cl.
*G09G 3/34* (2006.01)
*G09G 3/36* (2006.01)

(52) U.S. Cl.
CPC ..... *G09G 3/3426* (2013.01); *G09G 3/3648* (2013.01); *G09G 2320/0626* (2013.01); *G09G 2360/147* (2013.01)

(58) Field of Classification Search
CPC ..... G09G 3/3426; G09G 3/3648; G09G 2360/147; G09G 2320/0626
See application file for complete search history.

(56) References Cited

U.S. PATENT DOCUMENTS

2008/0284714 A1* 11/2008 Wu ..... H05B 45/00 345/102
2011/0227957 A1* 9/2011 Jung ..... G09G 3/3607 345/690

(Continued)

FOREIGN PATENT DOCUMENTS

CN 1877682 A 12/2006
CN 101253813 A 8/2008

(Continued)

OTHER PUBLICATIONS

Chinese Office Action dated Feb. 2, 2021, for Chinese Patent Application No. 202010472858.3, 31 pages.

*Primary Examiner* — Sahlu Okebato
(74) *Attorney, Agent, or Firm* — Christensen O'Connor Johnson Kindness PLLC

(57) ABSTRACT

Provided is a driving method for a display device. The driving method includes: obtaining, by the driving chip, a theoretical brightness value of the light-emitting diode in each of the plurality of light-exiting sub-areas based on an image to be displayed on the display panel; obtaining an actual brightness look-up table, searching the actual brightness look-up table for an actual brightness value closest to the theoretical brightness value, and setting the actual brightness value closest to the theoretical brightness value as a first brightness value; and generating a first pulse signal based on the first brightness value and outputting the first pulse signal to the switch in each of the plurality of light-exiting sub-areas, in such a manner that the switch controls, under driving of the first pulse signal, the light-emitting diode to emit light under an action of a first power supply signal and a second power supply signal.

13 Claims, 14 Drawing Sheets

(56) References Cited

U.S. PATENT DOCUMENTS

| | | | | |
|---|---|---|---|---|
| 2016/0093257 | A1* | 3/2016 | Wu | G09G 5/10 345/690 |
| 2020/0335047 | A1* | 10/2020 | Petrovich | G09G 3/3406 |
| 2021/0272526 | A1* | 9/2021 | Xu | G02F 1/133603 |

FOREIGN PATENT DOCUMENTS

| | | | |
|---|---|---|---|
| CN | 105810156 | A | 7/2016 |
| CN | 109935612 | A | 6/2019 |
| CN | 110264963 | A | 9/2019 |

* cited by examiner

DRIVING METHOD FOR DISPLAY DEVICE AND DISPLAY DEVICE

CROSS-REFERENCE TO RELATED APPLICATIONS

The present application claims priority to Chinese Patent Application No. CN202010472858.3, filed on May 29, 2020, the content of which is incorporated herein by reference in its entirety.

TECHNICAL FIELD

The present disclosure relates to the field of display technologies, and more particularly, to a driving method for a display device and a display device.

BACKGROUND

A liquid crystal display device includes a liquid crystal display panel and a backlight. For a direct-type backlight source formed by mini LEDs, two following methods are generally adopted in the related art to drive the mini LEDs to emit light. A first method is to divide a light-exiting region of the backlight source into a plurality of sub-regions, each of which is provided with one chip. The chip provides a driving signal to the mini LEDs to control the mini LEDs to emit light. However, with this driving method, if it is required to control a light-emitting brightness of the mini LEDs in the light-exiting region more precisely, the light-emitting region needs to be divided into a larger number of sub-regions. In this way, more driving chips will be needed, resulting in a higher production cost. A second method is to use a field programmable gate array (FPGA) to output a driving signal to the mini LEDs so as to control the mini LEDs to emit light. However, since the FPGA cannot be directly bonded to the liquid crystal display panel, it will occupy a larger space on a printed circuit board, also resulting in an increased production cost.

Therefore, how to use a low-cost driving method to drive the mini LEDs in the backlight source to emit light so as to decrease a production cost of the display device has become a technical problem to be solved at present.

SUMMARY

In view of this, embodiments of the present disclosure provide a driving method for a display device and a display device, aiming to decrease a driving cost of the backlight source so as to decrease a production cost of the display device.

The embodiments of the present disclosure provide a driving method for a display device. The display device includes: a display panel; a backlight source located at a side of the display panel facing away from a light-exiting surface of the display device, wherein the backlight source has a light-exiting area including a plurality of light-exiting sub-areas, and each of the plurality of light-exiting sub-areas is provided with a switch and a light-emitting diode electrically connected to the switch; and a driving chip bonded to the display panel. The driving method includes: obtaining, by the driving chip, a theoretical brightness value of the light-emitting diode in each of the plurality of light-exiting sub-areas based on an image to be displayed on the display panel; obtaining an actual brightness look-up table, searching the actual brightness look-up table for an actual brightness value closest to the theoretical brightness value, and setting the actual brightness value closest to the theoretical brightness value as a first brightness value; and generating a first pulse signal based on the first brightness value and outputting the first pulse signal to the switch in each of the plurality of light-exiting sub-areas, in such a manner that the switch controls, under driving of the first pulse signal, the light-emitting diode to emit light under an action of a first power supply signal and a second power supply signal.

The embodiments of the present disclosure further provide a display device, including: a display panel; a backlight source located at a side of the display panel facing away from a light-exiting surface of the display device, wherein the backlight source has a light-exiting area including a plurality of light-exiting sub-areas, and each of the plurality of light-exiting sub-areas is provided with a switch and a light-emitting diode electrically connected to the switch; and a driving chip bonded to the display panel and including a backlight driving circuit, the backlight driving circuit including a theoretical brightness obtaining module, a first brightness setting module, and a backlight controlling module. The theoretical brightness obtaining module is configured to obtain a theoretical brightness value of the light-emitting diode in each of the plurality of light-exiting sub-areas based on an image to be displayed on the display panel. The first brightness setting module is electrically connected to the theoretical brightness obtaining module, and is configured to obtain an actual brightness look-up table, which is searched for an actual brightness value closest to the theoretical brightness value, and the actual brightness value closest to the theoretical brightness value is set as a first brightness value. The backlight controlling module is electrically connected to the first brightness setting module, and is configured to generate a first pulse signal based on the first brightness value and output the first pulse signal to the switch in each of the plurality of light-exiting sub-areas, in such a manner that the switch controls, under driving of the first pulse signal, the light-emitting diode to emit light under an action of a first power supply signal and a second power supply signal.

One of the technical solutions described above has following beneficial effects.

By using the technical solutions provided by the embodiments of the present disclosure, the existing pulse signals that can be outputted by the existing driving chip in the display device can be used to drive the light-emitting diode in the backlight source to emit light. Therefore, there is no need to provide an additional chip or FPGA in the display device for driving the light-emitting diode, thereby reducing a driving cost of the backlight source and reducing a production cost of the display device.

In addition, since the driving chip is provided with a large number of pins and some of the pins are connected to the data lines and some other pins are free, according to the embodiments of the present disclosure, these free pins can be electrically connected to the switch in the backlight source, so that the driving chip can output the first pulse signal to the switch without an additional connection structure, thereby reducing the driving cost to a certain extent.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

In order to better understand technical solutions of the present disclosure, the embodiments of the present disclosure will be described in detail with reference to the drawings.

It should be clear that the described embodiments are merely part of the embodiments of the present disclosure rather than all the embodiments. All other embodiments obtained by those skilled in the art shall fall into the protection scope of the present disclosure.

The terms used in the embodiments of the present disclosure are merely for the purpose of describing specific embodiments, rather than limiting the present disclosure. The singular form "a", "an", "the" and "said" used in the embodiments and claims shall be interpreted as also including the plural form, unless indicated otherwise in the context.

It should be understood that the term "and/or" is used in the present disclosure merely to describe relations between associated objects, and thus includes three types of relations. That is, A and/or B can represent: (a) A exists alone; (b) A and B exist at the same time; or (c) B exists alone. In addition, the character "/" generally indicates "or".

Figure 1:
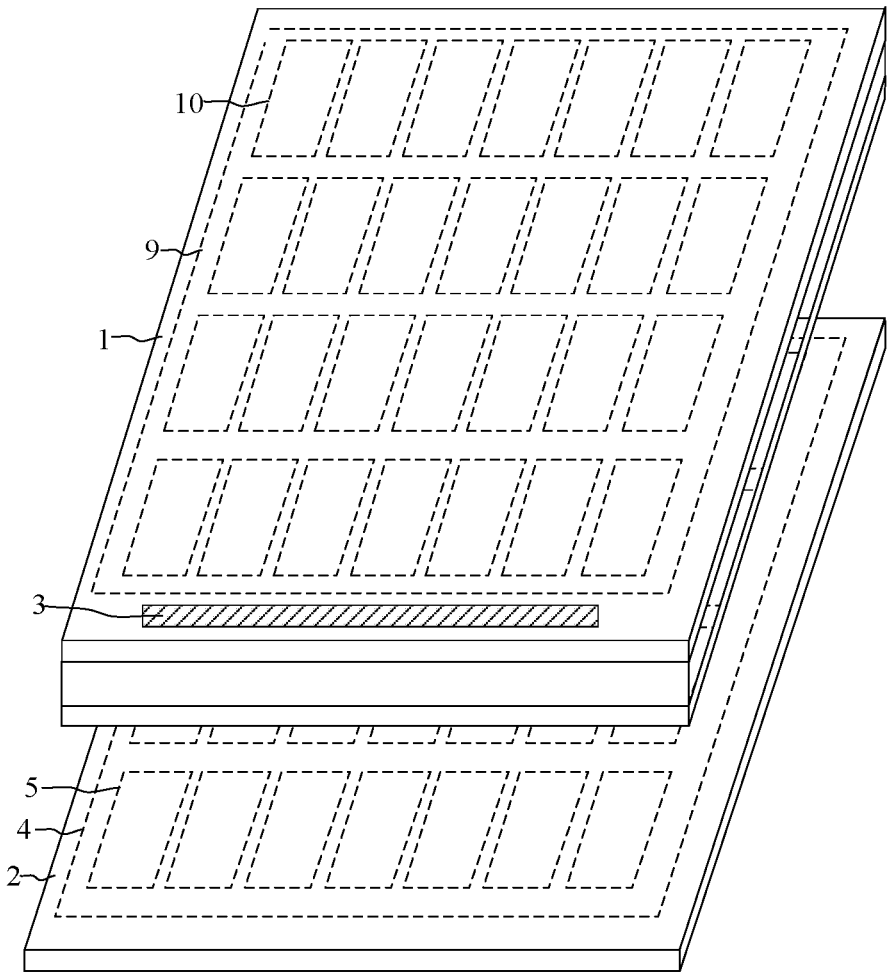
FIG. 1 is a schematic diagram of a structure of a display device according to an embodiment of the present disclosure.
Figure 2:
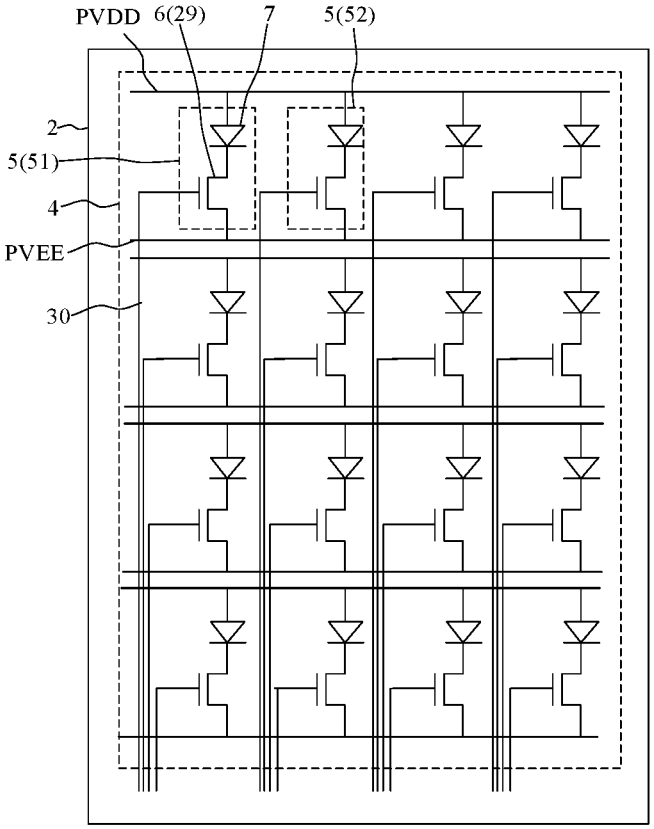
FIG. 2 is a schematic diagram of a structure of a backlight source according to an embodiment of the present disclosure.

The embodiments of the present disclosure provide a driving method for a display device. FIG. 1 is a schematic diagram of a structure of a display device according to an embodiment of the present disclosure. FIG. 2 is a schematic diagram of a structure of a backlight source according to an embodiment of the present disclosure. With reference to FIG. 1 and FIG. 2, the display device includes a display panel 1, a backlight source 2 and a driving chip 3. The backlight source 2 is located at a side of the display panel 1 facing away from a light-exiting surface of the display device, and a light-exiting area 4 of the backlight source 2 includes a plurality of light-exiting sub-areas 5, each of which is provided with a switch 6 and a light-emitting diode 7 electrically connected to the switch 6. Each of the sub-light-emitting areas 5 may be provided with only one light-emitting diode 7 or a plurality of light-emitting diodes 7 that is connected in series. The light-emitting diode 7 may be a micro light-emitting diode. Both the light-emitting diode 7 and the switch 6 are provided on a base substrate of the backlight source 2. The driving chip 3 is bonded to the display panel 1.

Figure 3:
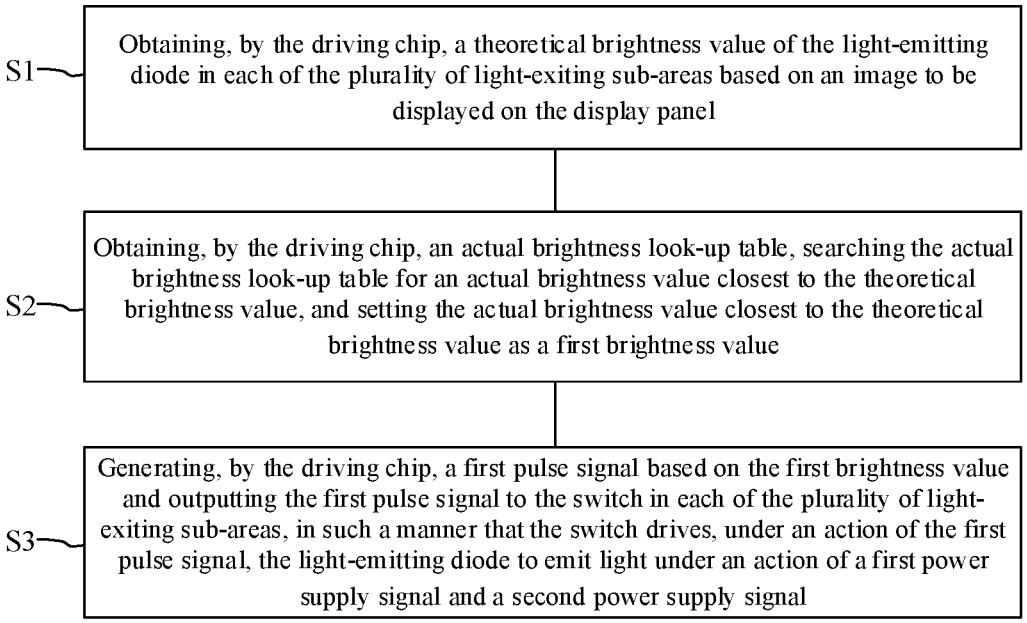
FIG. 3 is a flowchart of a driving method according to an embodiment of the present disclosure.

Based on the structure described above, as shown in FIG. 3, which is a flowchart of a driving method according to an embodiment of the present disclosure, the driving method according to this embodiment of the present disclosure includes following steps.

At step S1, the driving chip 3 obtains a theoretical brightness value of the light-emitting diode 7 in each light-exiting sub-area 5 based on an image to be displayed on the display panel 1.

At step S2, the driving chip 3 obtains an actual brightness look-up table, and searches the actual brightness look-up table for an actual brightness value closest to the theoretical brightness value, and sets the actual brightness value closest to the theoretical brightness value as a first brightness value. Here, the actual brightness look-up table refers to a look-up table containing multiple actual brightness values, which are different brightness values of light emitted by the light-emitting diode 7 when the switch 6 controls, under driving of the pulse signals having different duty ratios that the driving chip 3 can output, the light-emitting diode 7 to emit light. In other words, the actual brightness value refers to a brightness of light that the light-emitting diode 7 can display under driving of a pulse signal that the driving chip 3 can output based on the existing mechanism.

At step S3, the driving chip 3 generates a first pulse signal based on the first brightness value and outputs the first pulse signal to the switch 6 in each light-exiting sub-area 5, in such a manner that the switch 6 controls, under driving of the first pulse signal, the light-emitting diode 7 to emit light under an action of a first power supply signal and a second power supply signal. Here, the first power supply signal refers to a positive power supply signal provided by a first power supply signal line PVDD to a positive electrode of the light-emitting diode 7, and the second power supply signal refers to a negative power supply signal provided by a second power supply signal line PVEE to a negative electrode of the light-emitting diode 7.

Figure 4:
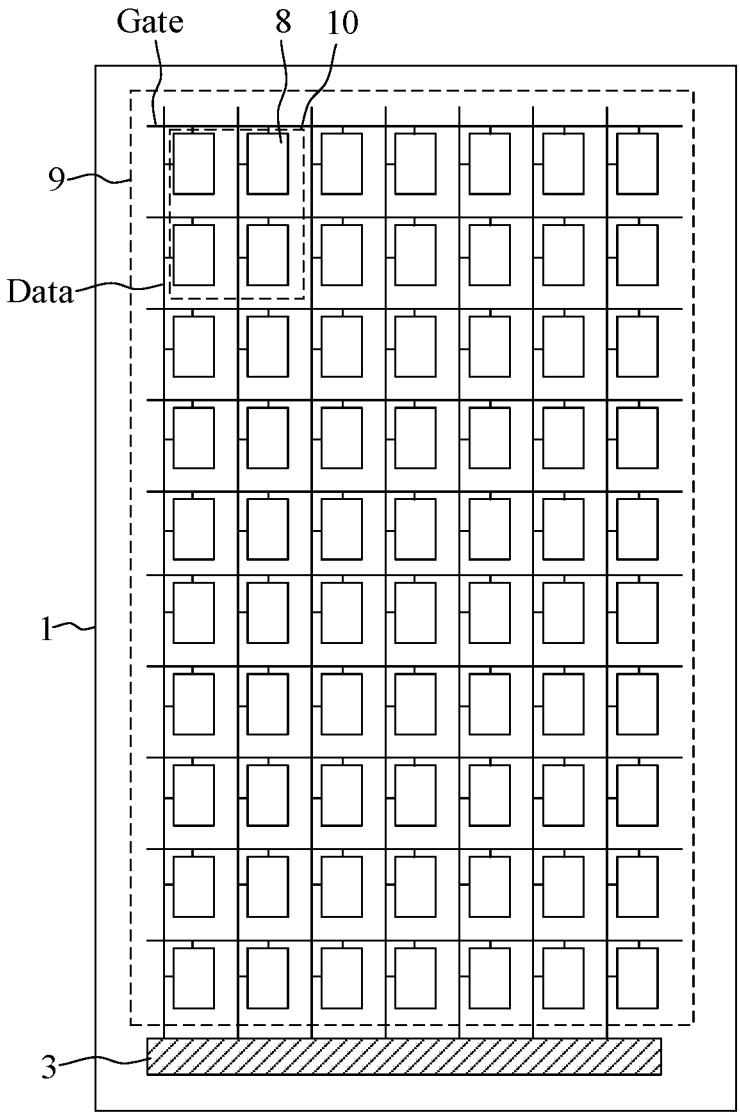
FIG. 4 is a schematic diagram of a structure of a display panel according to an embodiment of the present disclosure.

FIG. 4 is a schematic diagram of a structure of a display panel according to an embodiment of the present disclosure. With reference to FIG. 4, in order to better illustrate the driving method according to this embodiment of the present disclosure, the existing mechanism of outputting a pulse signal by the driving chip 3 will be first described in this embodiment of the present disclosure.

In the existing display device, in order to avoid permanent damage caused by polarization of liquid crystals, the driving chip 3 can output a pulse signal, which has alternate high and low levels, to a data line Data, in order to control the liquid crystals of sub-pixels 8 located in a same row to be deflected in different directions in different frames. For example, in two adjacent frames, in the first frame, a high level of the pulse signal is transmitted to the sub-pixels 8 located in an odd-numbered row, and a low level of the pulse signal is transmitted to the sub-pixels 8 located in an even-numbered row, thereby controlling the liquid crystals of the sub-pixels 8 located in the odd-numbered row to be deflected in a forward direction, and controlling the liquid crystals of the sub-pixels 8 located in the even-numbered row to be deflected in a backward direction; and in the second frame, a high level of the pulse signal is transmitted to the sub-pixels 8 located in an even-numbered row, and a low level of the pulse signal is transmitted to the sub-pixels 8 located in an odd-numbered row, thereby controlling the liquid crystals of the sub-pixels 8 located in the odd-numbered row to be deflected in a backward direction, and controlling the liquid crystals of the sub-pixels 8 located in the even-numbered row to be deflected in a forward direction. Moreover, it will be understood that, potentials of the high and low levels of the pulse signal represent data voltages for driving the sub-pixels 8 to emit light. Therefore, the pulse signals outputted by the driving chip 3 have various duty ratios depending on different light-emitting brightnesses of the sub-pixels 8.

Figure 5:
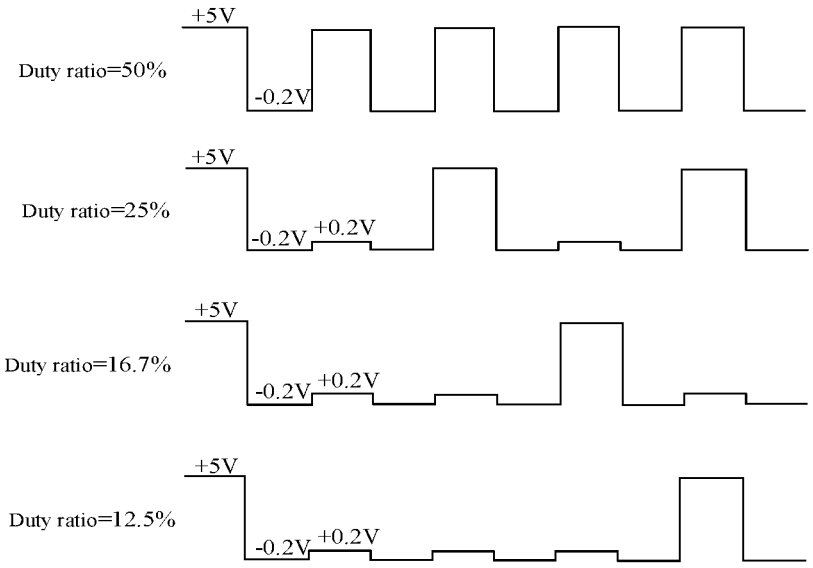
FIG. 5 illustrates waveform diagrams of pulse signals having four duty ratios that can be outputted by a driving chip according to an embodiment of the present disclosure.
Figure 6:
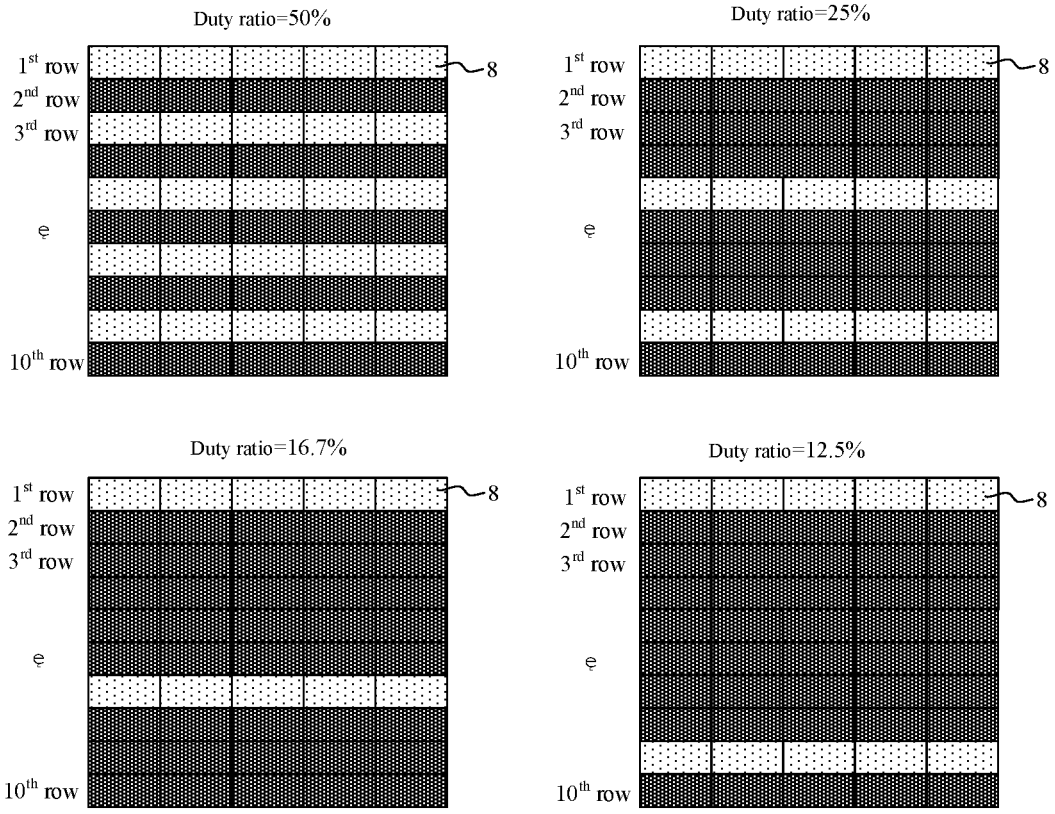
FIG. 6 schematically illustrates brightnesses of sub-pixels under the pulse signals having the four duty ratios shown in FIG. 5.

FIG. 5 illustrates waveform diagrams of pulse signals having four duty ratios that can be outputted by a driving chip according to an embodiment of the present disclosure. FIG. 6 schematically illustrates brightnesses of sub-pixels under the pulse signals having the four duty ratios shown in FIG. 5. In an example, as shown in FIG. 5 and FIG. 6, taking a pulse signal having a duty ratio of 50% outputted by the driving chip 3 as an example, in one frame, a gate line Gate corresponding the sub-pixels 8 located in a first row is turned on, a white-grayscale level (+5V) transmitted on the data line Data is written into the sub-pixels 8 located in the first row, and then liquid crystals of the sub-pixels 8 located in the first row are deflected in a forward direction, so that the sub-pixels 8 located in the first row present a higher brightness; then a gate line Gate corresponding to sub-pixels 8 located a second row is turned on, the black-grayscale level (−0.2V) transmitted on the data line Data is written into the sub-pixels 8 located in the second row, and then liquid crystals of the sub-pixels 8 located in the second row are deflected in a backward direction, so that the sub-pixels 8 located in the second row present a lower brightness; then a gate line Gate corresponding to sub-pixels 8 located in a third row is turned on, a white-grayscale level (+5V) transmitted on the data line Data is written into the sub-pixels 8 located in the third row, and then liquid crystals of the sub-pixels 8 located in the third row are deflected in a forward direction, so that the sub-pixels 8 located in the third row present a higher brightness; then a gate line Gate corresponding to sub-pixel 8 located in a fourth row is turned on, a black-grayscale level (−0.2V) transmitted on the data line Data is written into the sub-pixels 8 located in the fourth row, and then liquid crystals of the sub-pixels 8 located in the fourth row are deflected in a backward direction, so that the sub-pixels 8 located in the fourth row present a lower brightness; and so on.

In another example, the driving chip 3 outputs a pulse signal having a duty ratio of 25%, in combination with FIG. 6, in one frame, the gate line Gate corresponding to the sub-pixels 8 located in the first row is turned on, a white-grayscale level (+5V) transmitted on the data line Data is written into the sub-pixels 8 located in the first row, and then the liquid crystals of the sub-pixels 8 located in the first row are deflected in a forward direction, so that the sub-pixels 8 located in the first row present a higher brightness; then the gate line Gate corresponding to the sub-pixels 8 located in the second row is turned on, a black-grayscale level (−0.2V) transmitted on the data line Data is written into the sub-pixels 8 located in the second row, and then the liquid crystals of the sub-pixels 8 located in the second row are deflected in a backward direction, so that the sub-pixels 8 located in the second row present a lower brightness; then the gate line Gate corresponding to the sub-pixels 8 located in the third row is turned on, a black-grayscale level (+0.2V) transmitted on the data line Data is written into the sub-pixels 8 located in the third row, and then the liquid crystals of the sub-pixels 8 located in the third row are deflected in a forward direction, so that the sub-pixels 8 located in the third row present a lower brightness; then the gate line Gate corresponding to the sub-pixels 8 located in the fourth row is turned on, a black-grayscale level (−0.2V) transmitted on the data line Data is written into the pixel electrodes of the sub-pixels 8 located in the fourth row, and then the liquid crystals of the sub-pixels 8 located in the fourth row are deflected in a backward direction, so that the sub-pixels 8 located in the fourth row present a lower brightness; then a gate line Gate corresponding to sub-pixels 8 located in a fifth row is turned on, a white-grayscale level (+5V) transmitted on the data line Data is written into the sub-pixels 8 located in the fifth row, and then liquid crystals of the sub-pixels 8 located in the fifth row are deflected in a forward direction, so that the sub-pixels 8 located in the fifth row present a higher brightness; and so on.

In summary, the existing driving chip 3 can output a variety of pulse signals having different duty ratios. In this embodiments of the present disclosure, the driving chip can output some pulse signals, such as pulse signals having duty ratios of 50%, 25%, 16.7%, 12.5%, and 10%, for driving the light-emitting diode 7 in the backlight source 2 to emit light, so that the driving chip 3 is directly used to drive the light-emitting diode 7 in the backlight source 2 to emit light. However, it will be understood that if a pulse signal outputted by the driving chip 3 has a duty ratio of 1/n, where n can only be an integer, brightnesses of light emitted by the light-emitting diode are discontinuous when the light-emitting diode 7 is driven to emit light by such pulse signal. That is, after the driving chip 3 obtains the theoretical brightness value of the light-emitting diode 7 based on an image to be displayed on the display panel 1, the theoretical brightness value has a theoretical brightness value that is calculated based on data of the image to be displayed on the display panel 1. The theoretical brightness value may be any value, so the driving chip 3 may not directly output a pulse signal matching the theoretical brightness value. In view of this, in this embodiment of the present disclosure, an actual brightness look-up table is obtained and searched for an actual brightness value closest to the theoretical brightness value as a first brightness value of the light-emitting diode 7, so that the driving chip 3 can output the first pulse signal matching the brightness. Here, the first brightness value refers to a light-emitting brightness finally presented by the light-emitting diode 7 under driving of the driving chip 3. Since the first brightness value corresponds to an actual brightness value that can be found in the actual brightness look-up table, the driving chip 3 can output a pulse signal matching the first brightness value.

In an example, taking the pulse signals having the four duty ratios shown in FIG. 5 that can be outputted by the driving chip 3 as an example, when the pulse signals having the four duty ratios of 50%, 25%, 16.7% and 12.5% are respectively outputted to the switch 6, the actual brightness values of light emitted by the light-emitting diode 7 will be respectively L1, L2, L3, and L4. Assuming that the found actual brightness value closest to the theoretical brightness value of the light-emitting diode 7 is L4, then L4 is set as the first brightness value, and the driving chip 3 can directly output the first pulse signal having a duty ratio of 12.5% to the switch 6, thereby driving the light-emitting diode 7 to emit light of the first brightness value.

Therefore, by using the driving method provided by this embodiment of the present disclosure, the existing pulse signals that can be outputted by the existing driving chip 3 in the display device can be used to drive the light-emitting diode 7 in the backlight source 2 to emit light. Therefore, there is no need to provide an additional chip or FPGA in the display device for driving the light-emitting diode 7, thereby reducing a driving cost of the backlight source 2 and thus reducing a production cost of the display device.

In addition, it should be noted that, generally, the driving chip 3 is provided with a large number of pins, and some of the pins are connected to the data line Data and some other pins are free. In this embodiment of the present disclosure, these free pins can be electrically connected to the switch 6 in the backlight source 2, so that the driving chip 3 can output the first pulse signal to the switch 6 without an additional connecting structure, thereby reducing the driving cost to a certain extent.

In an embodiment, obtaining the actual brightness look-up table at step S2 includes: based on the pulse signal having each duty ratio that the driving chip 3 can output, obtaining different actual brightness values of light that the light-emitting diode 7 can emit when the switch 6 controls the light-emitting diode 7 to emit light under driving of the pulse signals having different duty ratios, and building the actual brightness look-up table based on the actual brightness values.

The actual brightness look-up table is built based on the actual brightness values corresponding to the pulse signal having each duty ratio that the driving chip 3 can output. After the theoretical brightness value of the light-emitting diode 7 is obtained, the actual brightness look-up table can be more accurately searched for the actual brightness value that is closest to the theoretical brightness value. When the light-emitting diode 7 is subsequently driven to emit light having such actual brightness value, the light-emitting brightness can be closer to the theoretical brightness value.

In an embodiment, searching the actual brightness look-up table for the actual brightness value closest to the theoretical brightness value and setting the actual brightness value closest to the theoretical brightness value as the first brightness in step S2 includes: calculating a difference between each actual brightness value in the actual brightness look-up table and the theoretical brightness value, where the difference may be 0; and comparing these differences to determine a minimum difference, and setting an actual brightness value corresponding to the minimum difference as the first brightness value. In a case where there are two different actual brightness values corresponding to the minimum difference, the actual brightness value having the smaller brightness value among the two different actual brightness values is set as the first brightness value.

When there are two different actual brightness values closest to the theoretical brightness value in the actual brightness look-up table, the actual brightness value having the smaller brightness value among the two different actual brightness values is set as the first brightness value, so that power consumption of the light-emitting diode 7 can be reduced when the first pulse signal corresponding to the smaller brightness value drives the light-emitting diode 7 to emit light.

In an embodiment, with reference to FIG. 1 and FIG. 4, the display panel 1 is provided with gate lines Gate and data lines Data, and the gate lines Gate intersect the data lines Data in an insulation way to define a plurality of sub-pixels 8. The display area 9 includes a plurality of display sub-areas 10, which corresponds to the plurality of light-exiting sub-areas 5 in one-to-one correspondence, and each display sub-area 10 is provided with at least one sub-pixel 8.

Figure 7:
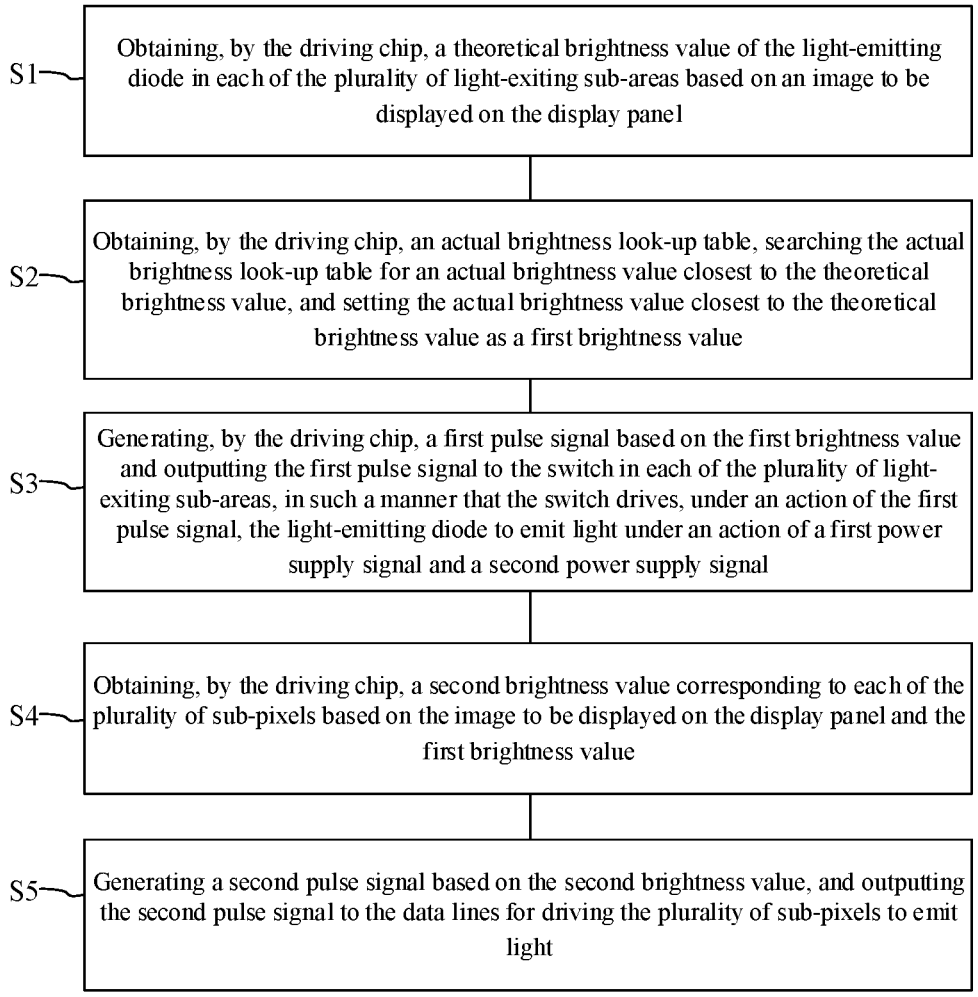
FIG. 7 is another flowchart of a driving method according to an embodiment of the present disclosure.

FIG. 7 is another flowchart of a driving method according to an embodiment of the present disclosure. As shown in FIG. 7, the driving method includes following steps.

At step S4, the driving chip 3 obtains a second brightness value corresponding to each sub-pixel 8 based on the image to be displayed on the display panel 1 and the first brightness value.

At step S5, the driving chip 3 generates a second pulse signal based on the second brightness value, and outputs the second pulse signal to the data line Data to drive the sub-pixel 8 to emit light.

In an example, when the sub-pixel 8 is driven to emit light and the gate line Gate corresponding to the pixel row where the sub-pixel 8 is located is turned on, a high-level voltage or a low-level voltage of the pulse signal provided by the driving chip 3 to the data line Data is written into a pixel electrode of the sub-pixel 8. Then, an electric field is formed between the pixel electrode and a common electrode to drive the liquid crystals to deflect, so that the sub-pixel 8 emits light. It will be understood that the high-level voltage or low-level voltage of the pulse signal refers to an amplitude voltage of the pulse signal, which is determined based on a required light-emitting brightness of the sub-pixel 8. The second brightness value as described above refers to a light-emitting brightness finally presented by the sub-pixel 8 when the sub-pixel 8 is driven by the driving chip 3 to emit light. Generating the second pulse signal based on the second brightness value refers to determining the amplitude voltage based on the second brightness value and then generating the corresponding second pulse signal based on the determined amplitude voltage.

When the display device includes the display panel 1 and the backlight source 2, an overall brightness of a region where each sub-pixel 8 in the display panel 1 is located is related not only to a light-exiting brightness in the light-exiting sub-area 5 corresponding to the display sub-area 10 to which this region belongs, but also to the light-emitting brightness of the sub-pixel 8 in this region. In this embodiment of the present disclosure, after the first brightness value of the light-emitting diode 7 in each light-exiting sub-area 5 is obtained, the second brightness value corresponding to each sub-pixel 8 is obtained based on the first brightness value, thereby achieving mutual coordination of these two brightness values. In this way, the overall brightness of the region where each sub-pixel 8 is located is the brightness required by the image to be displayed on the display panel 1, thereby achieving accurate display.

Figure 8:
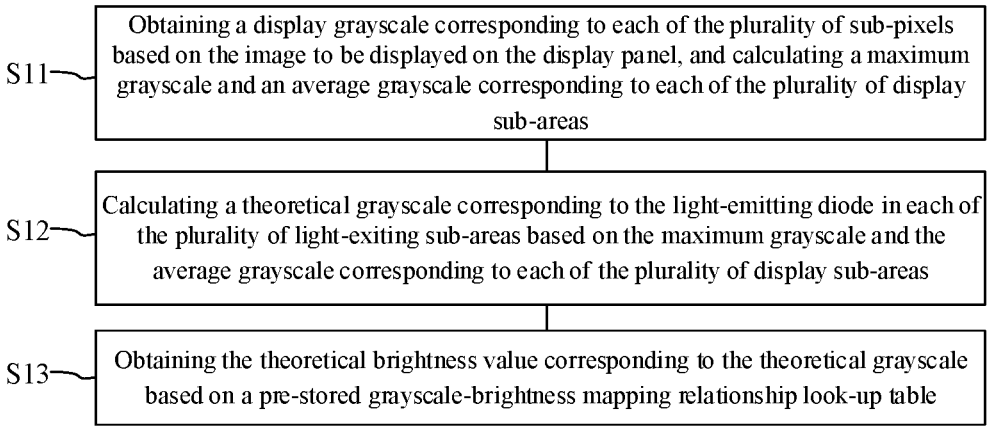
FIG. 8 is still another flowchart of a driving method according to an embodiment of the present disclosure.

In an embodiment, as shown in FIG. 8, which is still another flowchart of a driving method according to an embodiment of the present disclosure, the step S1 may include following steps.

At step S11, a display grayscale corresponding to each sub-pixel 8 is obtained based on the image to be displayed on the display panel 1, and a maximum grayscale and an average grayscale corresponding to each display sub-area 10 is calculated.

At step S12, a theoretical grayscale corresponding to the light-emitting diode 7 in each light-exiting sub-area 5 is calculated based on the maximum grayscale and average grayscale corresponding to each display sub-area 10.

At step S13, a theoretical brightness value corresponding to the theoretical grayscale is obtained based on a pre-stored grayscale-brightness mapping relationship look-up table.

In the driving method described above, the theoretical grayscale corresponding to the light-emitting diode 7 in each light-exiting sub-area 5 is obtained based on the maximum grayscale and the average grayscale of the display sub-area 10 corresponding to the light-exiting sub-area 5 where the light-emitting diode 7 is located. That is, the theoretical brightness value of the light-emitting diode 7 is related to display of the corresponding display sub-area 10. Through mutual cooperation of the light-exiting brightnesses of the backlight source 2 and the display panel 1, the brightness required for the image to be displayed on the display panel 1 can be presented, so as to achieve normal display of the display panel 1.

Figure 9:
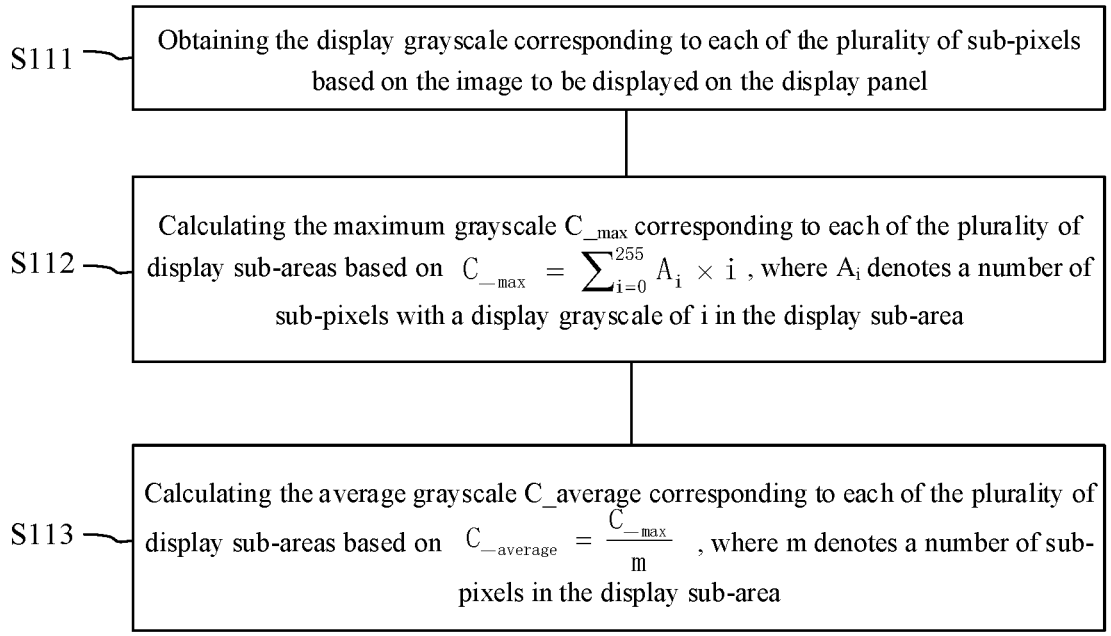
FIG. 9 is yet another flowchart of a driving method according to an embodiment of the present disclosure.

Further, as shown in FIG. 9, which is yet another flowchart of a driving method according to an embodiment of the present disclosure, the step S11 includes following steps.

At step S111, a display grayscale corresponding to each sub-pixel 8 is obtained based on the image to be displayed on the display panel 1.

At step S112, the maximum grayscale C_max corresponding to each display sub-area 10 is calculated based on $C_{_max}=\Sigma_{i=0}^{255}A_i\times i$, where $A_i$ denotes a number of sub-pixels 8 with a display grayscale of i in the display sub-area 10.

At step S113, the average grayscale C_average corresponding to each display sub-area 10 is calculated based on $$C_{_average}=\frac{C_{_max}}{m},$$

where m denotes a number of sub-pixels 8 in the display sub-area 10.

Correspondingly, the step S12 may include: calculating the theoretical grayscale $C_{_LED}'$ corresponding to the light-emitting diode 7 in each light-exiting sub-area 5 based on $C_{_LE}'=C_{_max}\times\text{rate}+C_{_average}\times(1-\text{rate})$, where rate denotes a ratio of the average grayscale $C_{_average}$ to the maximum grayscale $C_{_max}$, and $0\leq\text{rate}\leq1$, for example rate=0.5.

Since the light-exiting sub-areas 5 correspond to the display sub-areas 10 in one-to-one correspondence, after the display grayscale corresponding to each sub-pixel 8 is obtained, the maximum grayscale and the average grayscale of each display sub-area 10 are further obtained, and then the theoretical grayscale of the corresponding light-exiting sub-area 5 is obtained based on the maximum grayscale and the average grayscale of the display sub-area 10. In this way, the light-exiting brightness required for the display device is achieved through mutual cooperation of the light-exiting brightnesses of the backlight source 2 and the display panel 1.

Figure 10:
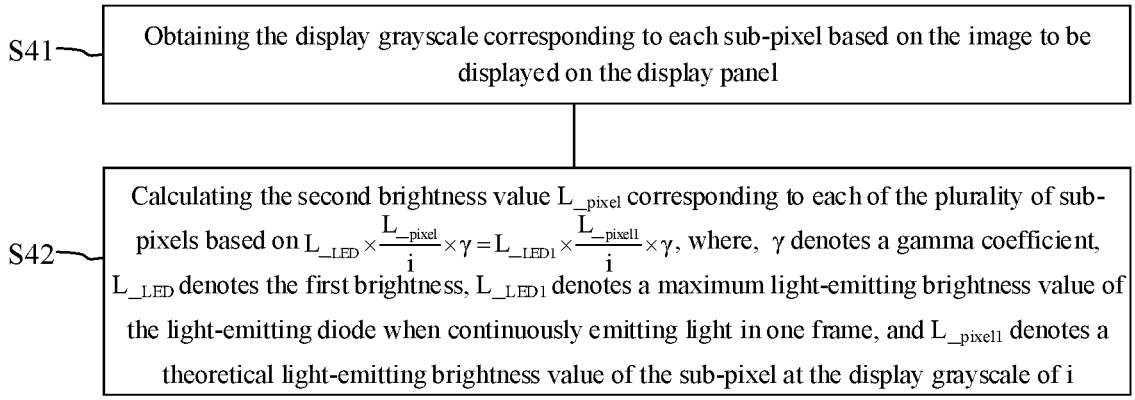
FIG. 10 is another flowchart of a driving method according to an embodiment of the present disclosure.

In an embodiment, as shown in FIG. 10, which is another flowchart of a driving method according to an embodiment of the present disclosure, step S4 includes following steps.

At step S41, the display grayscale corresponding to each sub-pixel 8 is obtained based on the image to be displayed on the display panel 1.

At step S42, the second brightness value $L_{_pixel}$ corresponding to each sub-pixel 8 is calculated based on $$L_{_LED}\times\frac{L_{_pixel}}{i}\times\gamma=L_{_LED1}\times\frac{L_{_pixel_1}}{i}\times\gamma,$$

where, γ denotes a gamma coefficient, $L_{_LED}$ denotes the first brightness value, $L_{_LED1}$ denotes a maximum light-emitting brightness value of the light-emitting diode 7 when the light-emitting diode 7 continuously emits light in one frame, and $L_{_pixel_1}$ denotes the theoretical light-emitting brightness value of the sub-pixel 8 at the display grayscale of i.

With the driving method described above, the second brightness value of each sub-pixel 8 in the display sub-area 10 corresponding thereto can be obtained based on the first brightness value of the light-emitting diode 7 in each light-exiting sub-area 5 of the backlight source 2, so that the light-exiting brightness value of each sub-pixel 8 is individually controlled to improve an accuracy of the light-emitting brightness value of each sub-pixel 8.

In an embodiment, in combination with FIG. 2, the light-exiting sub-areas 5 include a first light-exiting sub-area 51 and a second light-exiting sub-area 52, and the first brightness value corresponding to the first light-exiting sub-area 51 is greater than the first brightness value corresponding to the second light-exiting sub-area 52. The duty ratio of the first pulse signal corresponding to the first light-exiting sub-area 51 is greater than the duty ratio of the first pulse signal corresponding to the second light-exiting sub-area 52.

In this way, in one cycle, a duration of a level of the first pulse signal corresponding to the first light-exiting sub-area 51 that can drive the switch 6 to be turned on is longer than a duration of a level of the first pulse signal corresponding to the second light-exiting sub-area 52, so that the switch 6 in the first light-exiting sub-area 51 is in a turned-on state for a longer duration. Therefore, the switch 6 can drive the light-emitting diode 7 to emit light for a longer duration, thereby allowing the light-emitting diode 7 in the first light-exiting sub-area 51 to have a greater light-emitting brightness value.

Alternatively, with reference to FIG. 2, the light-exiting sub-areas 5 includes a first light-exiting sub-area 51 and a second light-exiting sub-area 52, and the first brightness value corresponding to the first light-exiting sub-area 51 is greater than the first brightness value corresponding to the second light-exiting sub-areas 52. A duration in which the first pulse signal is outputted to the switch 6 in the first light-exiting sub-area 51 is longer than a duration in which the first pulse signal is outputted to the switch 6 in the second light-exiting sub-area 52.

In this way, the duration in which the switch 6 receives the first pulse signal in the first light-exiting sub-area 51 is longer. Correspondingly, a duration in which the switch 6 is in a turned-on state under an effect of an effective level of the first pulse signal is longer. Therefore, the switch 6 drives the light-emitting diode 7 to emit light for a longer period, thereby allowing the light-emitting diode 7 in the first light-exiting sub-area 51 to have a greater light-emitting brightness value.

In an embodiment, the second power supply signal is usually 0V. In this case, a voltage of the first power supply signal may be set to be larger than a threshold voltage of the light-emitting diode 7, so that a difference between the voltage of the first power supply signal and a voltage of the second power supply signal is larger than the threshold voltage of the light-emitting diode 7, thereby allowing the light-emitting diode 7 to work normally when the switch 6 is turned on.

Figure 11:
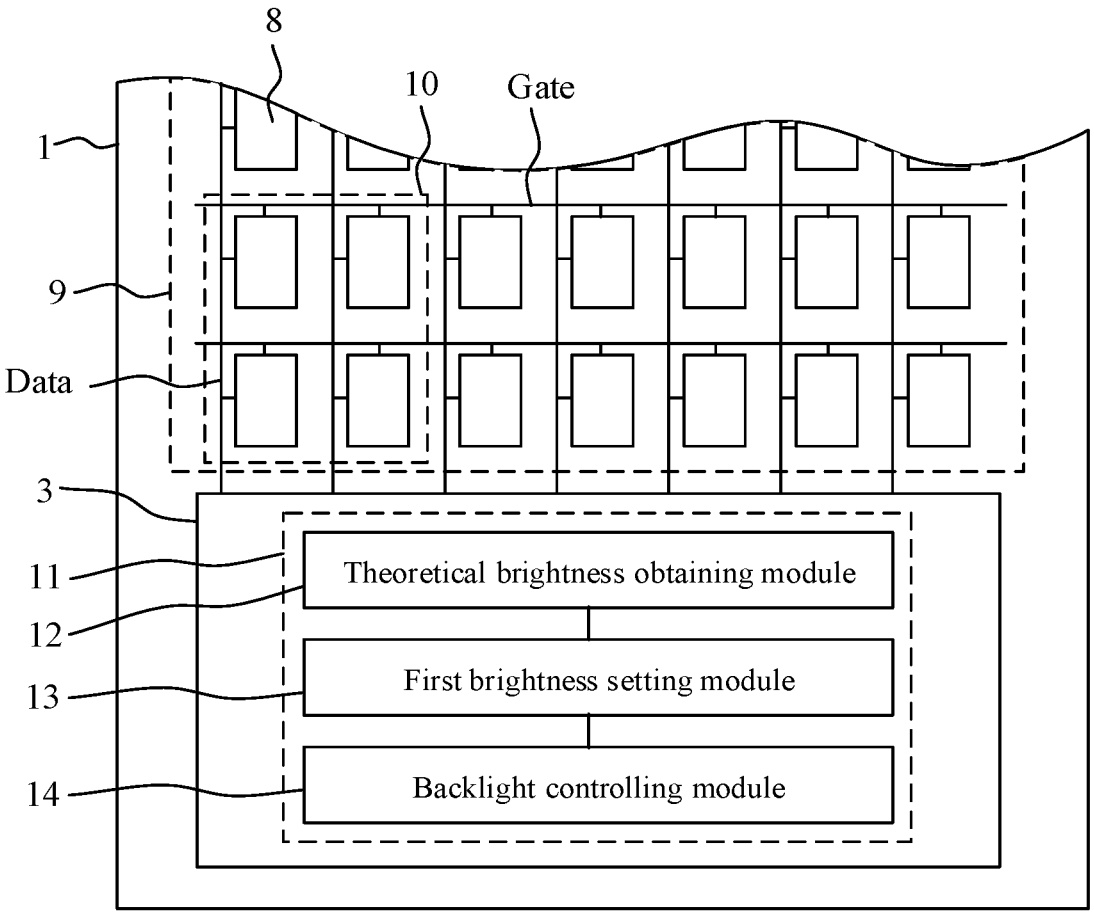
FIG. 11 is a schematic diagram of a structure of a driving chip according to an embodiment of the present disclosure.

An embodiment of the present disclosure further provides a display device. In combination with FIG. 1 and FIG. 2, and as shown in FIG. 11, which is a schematic diagram of a structure of a driving chip according to an embodiment of the present disclosure, the display device includes a display panel 1, a backlight source 2 and a driving chip 3. The backlight source 2 is located at a side of the display panel 1 facing away from the light-exiting surface of the display device, and the light-exiting area 4 of the backlight source 2 includes a plurality of light-exiting sub-areas 5, each of which is provided with a switch 6 and a light-emitting diode 7 electrically connected to the switch 6. The light-emitting diode 7 may be a micro light-emitting diode, and both the light-emitting diode 7 and the switch 6 are arranged on a base substrate of the backlight source 2. The driving chip 3 is bonded to the display panel 1. The driving chip 3 includes a backlight driving circuit 11, and the backlight driving circuit 11 includes a theoretical brightness obtaining module 12, a first brightness setting module 13, and a backlight controlling module 14.

The theoretical brightness obtaining module 12 is configured to obtain a theoretical brightness value of the light-emitting diode 7 in each light-exiting sub-area 5 based on an image to be displayed on the display panel 1. The first brightness setting module 13 is electrically connected to the theoretical brightness obtaining module 12 to obtain an actual brightness look-up table, which is searched for an actual brightness value closest to the theoretical brightness value, and the actual brightness value closest to the theoretical brightness value is set as a first brightness. The actual brightness look-up table contains multiple actual brightness values, which are different brightness values of light emitted by the light-emitting diode 7 when the switch 6 controls, under driving of the pulse signals having different duty ratios that the driving chip 3 can output, the light-emitting diode 7 to emit light. The backlight controlling module 14 is electrically connected to the first brightness setting module 13 to generate a first pulse signal based on the first brightness value and output the first pulse signal to the switch 6 in each light-exiting sub-area 5, in such a manner that the switch 6 controls, under driving of the first pulse signal, the light-emitting diode 7 to emit light under an action of a first power supply signal and a second power supply signal.

The driving method for the backlight driving circuit 11 has been illustrated in the details of the above-described embodiments, and will not be repeated herein.

For the display device provided by this embodiment of the present disclosure, the existing pulse signals that can be outputted by the existing driving chip 3 in the display device can be used to drive the light-emitting diode 7 in the backlight source 2 to emit light. Therefore, there is no need to provide an additional chip or FPGA in the display device for driving the light-emitting diode 7, thereby reducing a driving cost of the backlight source 2 and reducing a production cost of the display device. Moreover, in this embodiment of the present disclosure, the free pins of the driving chip 3 can be electrically connected to the switch 6 in the backlight source 2, so that the driving chip 3 can output the first pulse signal to the switch 6 without an additional connection structure, thereby reducing the driving cost to a certain extent.

Figure 12:
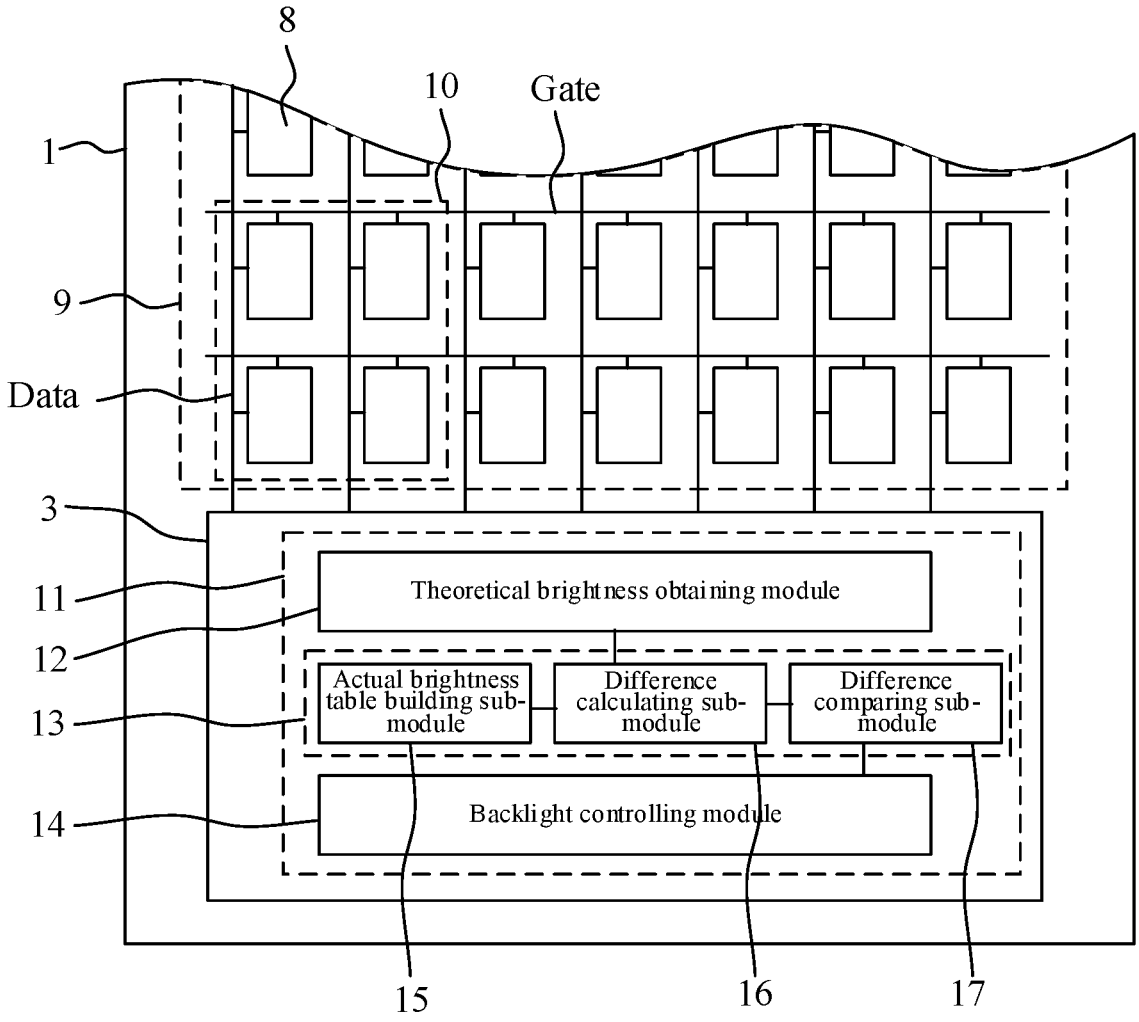
FIG. 12 is another schematic diagram of a structure of a driving chip according to an embodiment of the present disclosure.

FIG. 12 is another schematic diagram of a structure of a driving chip according to an embodiment of the present disclosure. In an embodiment, as shown in FIG. 12, the first brightness setting module 13 includes an actual brightness table building sub-module 15, a difference calculating sub-module 16, and a difference comparing sub-module 17.

The actual brightness table building sub-module 15 is configured to obtain different actual brightness values of light that the light-emitting diode 7 can emit when the switch 6 controls the light-emitting diode 7 to emit light under driving of the pulse signals having different duty ratios, and build the actual brightness look-up table based on the actual brightness values. The difference calculating sub-module 16 is electrically connected to the theoretical brightness obtaining module 12 and the actual brightness table building sub-module 15, and is configured to calculate a difference between each actual brightness value contained in the actual brightness look-up table and the theoretical brightness value. The difference comparing sub-module 17 is electrically connected to the difference calculating sub-module 16 and the backlight controlling module 14, and is configured to compare these differences to determine a minimum difference, and set the actual brightness value corresponding to the minimum difference as the first brightness value. In a case where two different actual brightness values correspond to the minimum difference, the actual brightness having the smaller brightness value among the two different actual brightness values is set as the first brightness value, so as to reduce the power consumption of the light-emitting diode 7.

The actual brightness table building sub-module 15 builds the actual brightness look-up table based on the actual brightness value corresponding to the pulse signal having each duty ratio that the driving chip 3 can output. After the theoretical brightness value of the light-emitting diode 7 is obtained, the actual brightness look-up table can be more accurately searched for the actual brightness value that is closest to the theoretical brightness value. When the light-emitting diode 7 is subsequently driven to emit light having such actual brightness value, this light-emitting brightness can be closer to the theoretical brightness value.

Figure 13:
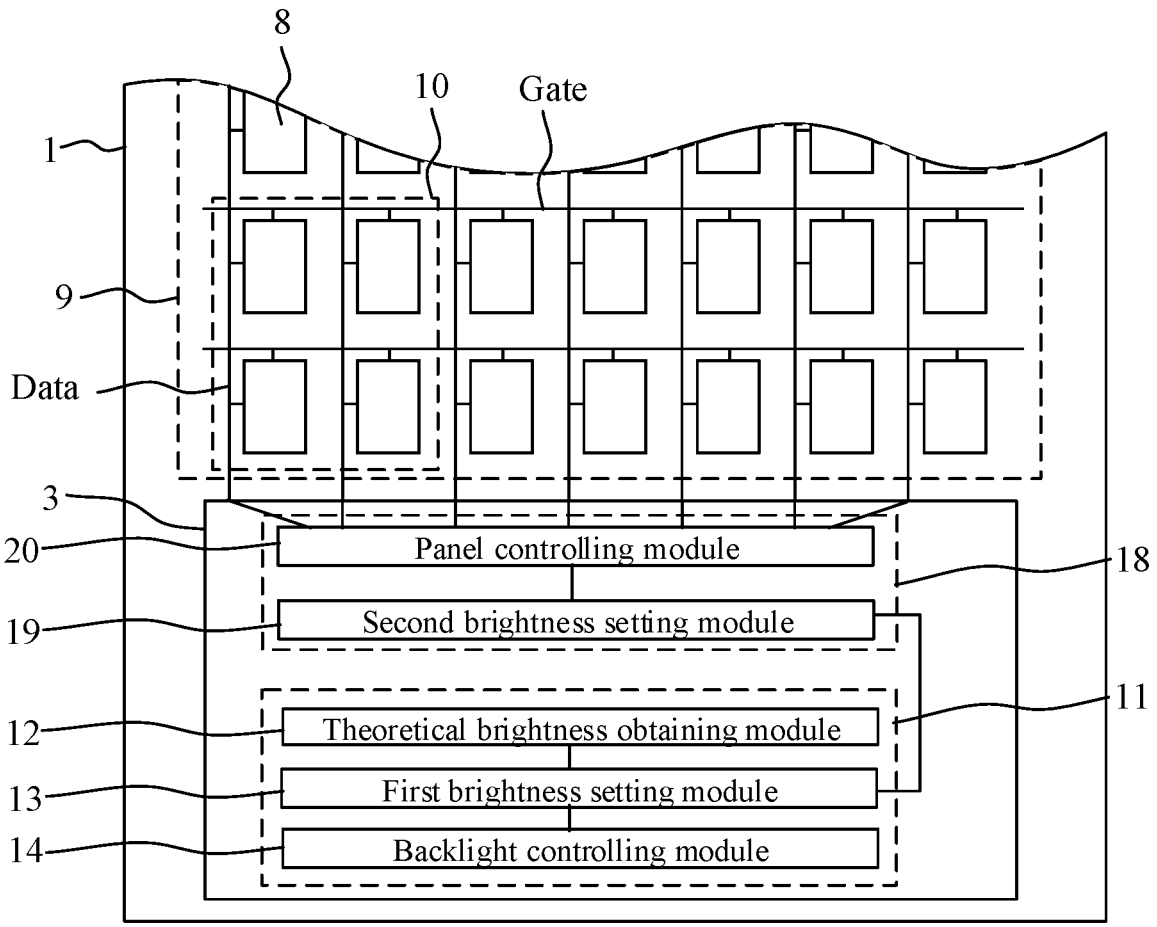
FIG. 13 is still another schematic diagram of a structure of a driving chip according to an embodiment of the present disclosure.

FIG. 13 is still another schematic diagram of a structure of a driving chip according to an embodiment of the present disclosure. In an embodiment, in combination with FIG. 3 and as shown in FIG. 13, the display panel 1 is provided with gate lines Gate and data lines Data, and the gate lines Gate intersect the data lines Data in an insulated way to define a plurality of sub-pixels 8. The display area 9 includes a plurality of display sub-areas 10, which corresponds to the plurality of light-exiting sub-areas 5 in one-to-one correspondence, and each of the plurality of display sub-areas 10 is provided with at least one sub-pixel 8.

The driving chip 3 further includes a panel driving circuit 18, and the panel driving circuit 18 includes a second brightness setting module 19 and a panel controlling module 20. The second brightness setting module 19 is electrically connected to the first brightness setting module 13 and is configured to obtain the second brightness value corresponding to each sub-pixel 8 based on the image to be displayed on the display panel 1 and the first brightness value. The panel controlling module 20 is electrically connected to the second brightness setting module 19 and is configured to generate a second pulse signal based on the second brightness value and output the second pulse signal to the data line Data so as to drive the sub-pixel 8 to emit light.

Since the overall brightness of a region where each sub-pixel 8 in the display panel 1 is located is related not only to the light-exiting brightness in the light-exiting sub-area 5 corresponding to the display sub-area 10 to which this region belongs, but also to the light-emitting brightness of the sub-pixel 8 in this region. In this embodiment of the present disclosure, the second brightness corresponding to each sub-pixel 8 is obtained based on the first brightness of the light-emitting diode 7 in the corresponding light-exiting sub-area 5, thereby achieving mutual coordination of these two brightnesses. In this way, the overall brightness of the region where each sub-pixel 8 is located is the brightness required by the image to be displayed on the display panel 1, thereby achieving accurate display.

Figure 14:
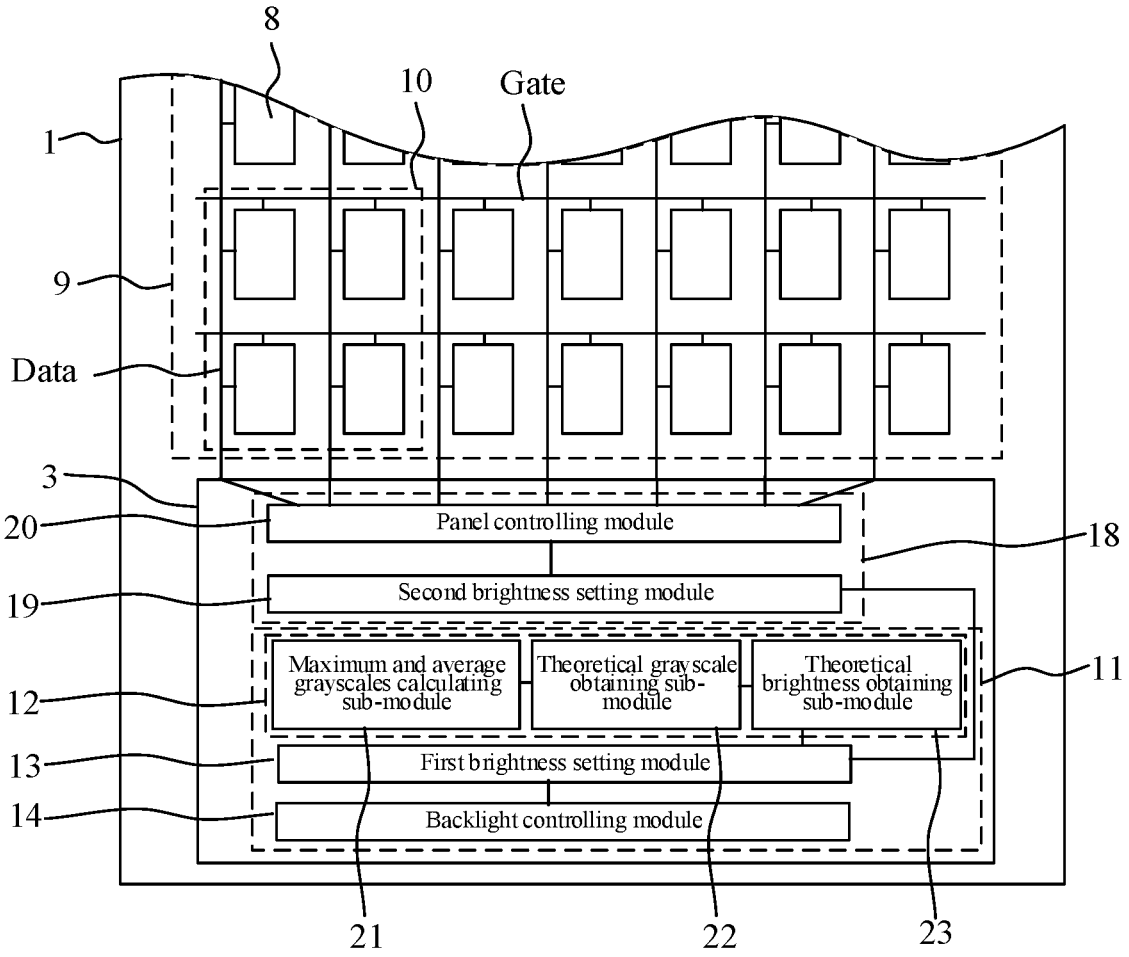
FIG. 14 is yet another schematic diagram of a structure of a driving chip according to an embodiment of the present disclosure.

FIG. 14 is yet another schematic diagram of a structure of a driving chip according to an embodiment of the present disclosure. In an embodiment, as shown in FIG. 14, the theoretical brightness obtaining module 12 includes a maximum and average grayscale calculating sub-module 21, a theoretical grayscale obtaining sub-module 22, and a theoretical brightness obtaining sub-module 23.

The maximum and average grayscales calculating sub-module 21 is configured to obtain a display grayscale corresponding to each sub-pixel 8 based on the image to be displayed on the display panel 1, and calculate the maximum grayscale and the average grayscale corresponding to each display sub-area 10. The theoretical grayscale obtaining sub-module 22 is electrically connected to the maximum and average grayscales calculating sub-module 21, and is configured to calculate the theoretical grayscale corresponding to the light-emitting diode 7 in each light-exiting sub-area 5 based on the maximum grayscale and the average grayscale corresponding to each display sub-area 10. The theoretical brightness obtaining sub-module 23 is electrically connected to the theoretical grayscale obtaining sub-module 22 and the first brightness setting module 13, and is configured to obtain the theoretical brightness value corresponding to the theoretical grayscale based on the pre-stored grayscale-brightness mapping relationship look-up table.

Since the theoretical grayscale corresponding to the light-emitting diode 7 in each light-exiting sub-area 5 is obtained based on the maximum grayscale and the average grayscale of the display sub-area 10 corresponding to the light-exiting sub-area 5 where the light-emitting diode 7 is located, that is, the theoretical brightness value of the light-emitting diode 7 is related to display of the corresponding display sub-area 10. Through mutual cooperation of the light-exiting brightnesses of the backlight source 2 and the display panel 1, the brightness required for the image to be displayed on the display panel 1 can be presented, so as to achieve normal display of the display panel 1.

Figure 15:
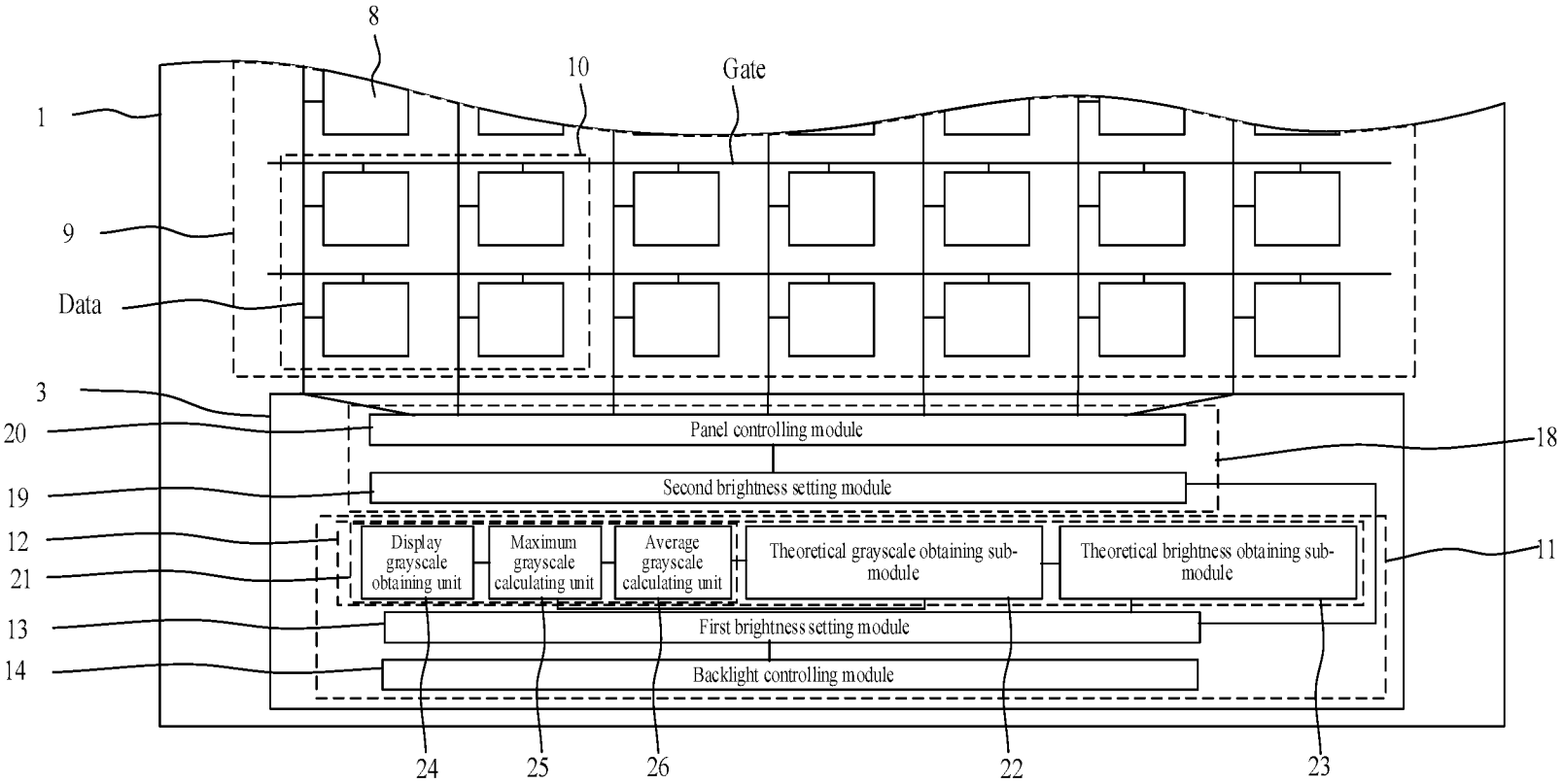
FIG. 15 is another schematic diagram of a structure of a driving chip according to an embodiment of the present disclosure.

Further, as shown in FIG. 15, which is another schematic diagram of a structure of a driving chip according to an embodiment of the present disclosure, the maximum and average grayscales calculating sub-module 21 includes a display grayscale obtaining unit 24, a maximum grayscale calculating unit 25, and an average grayscale calculating unit 26.

The display grayscale obtaining unit 24 is configured to obtain a display grayscale corresponding to each sub-pixel 8 based on the image to be displayed on the display panel 1. The maximum grayscale calculating unit 25 is electrically connected to the display grayscale obtaining unit 24 and the theoretical grayscale obtaining sub-module 22, and is configured to calculate the maximum grayscale C_max corresponding to each display sub-area 10 based on $C_{-max}=\Sigma_{i=0}^{255}A_i\times i$, where $A_i$ denotes a number of sub-pixels 8 with a grayscale of i in the display sub-area 10. The average grayscale calculating unit 26 is electrically connected to the maximum grayscale calculating unit 25 and the theoretical grayscale obtaining sub-module 22, and is configured to calculate the average grayscale $C_{-average}$ corresponding to each display sub-area 10 based on $$C_{-average}=\frac{C_{-max}}{m},$$

where m denotes a number of sub-pixels 8 in the display sub-area 10.

On basis of this, the theoretical grayscale obtaining sub-module 22 is configured to calculate the theoretical grayscale $C_{-LED}'$ corresponding to the light-emitting diode 7 in each light-exiting sub-area 5 based on $C_{-LED}'=C_{-max}\times rate+C_{-average}\times(2-rate)$, where $0\leq rate\leq 1$.

Since the light-exiting sub-areas 5 correspond to the display sub-areas 10 in one-to-one correspondence, after the display grayscale corresponding to each sub-pixel 8 is obtained, the maximum grayscale and the average grayscale of each display sub-area 10 are further obtained, and then the theoretical grayscale of the corresponding light-exiting sub-area 5 is obtained based on the maximum grayscale and the average grayscale of the display sub-area 10. In this way, the light-exiting brightness required for the display device is achieved through mutual cooperation of the light-exiting brightnesses of the backlight source 2 and the display panel 1.

Figure 16:
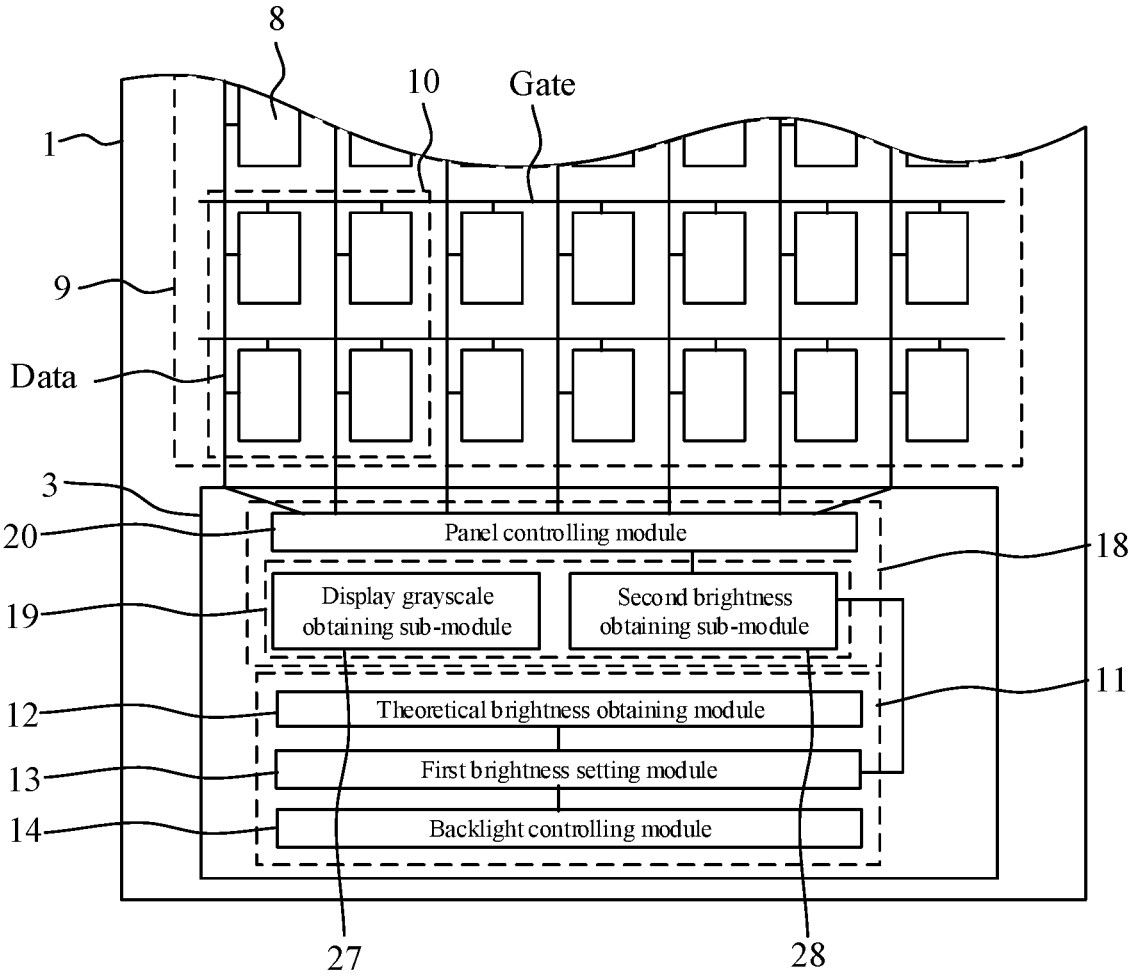
FIG. 16 is still another schematic diagram of a structure of a driving chip according to an embodiment of the present disclosure.

In an embodiment, as shown in FIG. 16, which is still another schematic diagram of a structure of a driving chip according to an embodiment of the present disclosure, the second brightness setting module 19 includes a display grayscale obtaining sub-module 27 and a second brightness obtaining sub-module 28.

The display grayscale obtaining sub-module 27 is configured to obtain the display grayscale corresponding to each sub-pixel 8 based on the image to be displayed on the display panel 1. The second brightness obtaining sub-module 28 is electrically connected to the display grayscale obtaining sub-module 27 and the first brightness setting module 13, and is configured to calculate the second brightness value $L_{pixel}$ corresponding to each sub-pixel 8 based on $$L_{-LED}\times\frac{L_{-pixel}}{i}\times\gamma=L_{-LED1}\times\frac{L_{-pixel_1}}{i}\times\gamma,$$

where, γ denotes a gamma coefficient, $L_{-LED}$ denotes the first brightness value, $L_{-LED1}$ denotes a maximum light-emitting brightness value of the light-emitting diode 7 when the light-emitting diode 7 continuously emits light in one frame, and $L_{pixel_1}$ denotes the theoretical light-emitting brightness value of the sub-pixel 8 in a case of the display grayscale of i.

The second brightness value of each sub-pixel 8 in the display sub-area 10 corresponding thereto is obtained based on the first brightness value of the light-emitting diode 7 in each light-exiting sub-area 5 of the backlight source 2, so that the light-exiting brightness value of each sub-pixel 8 is individually controlled to improve an accuracy of the light-emitting brightness value of each sub-pixel 8.

Figure 17:
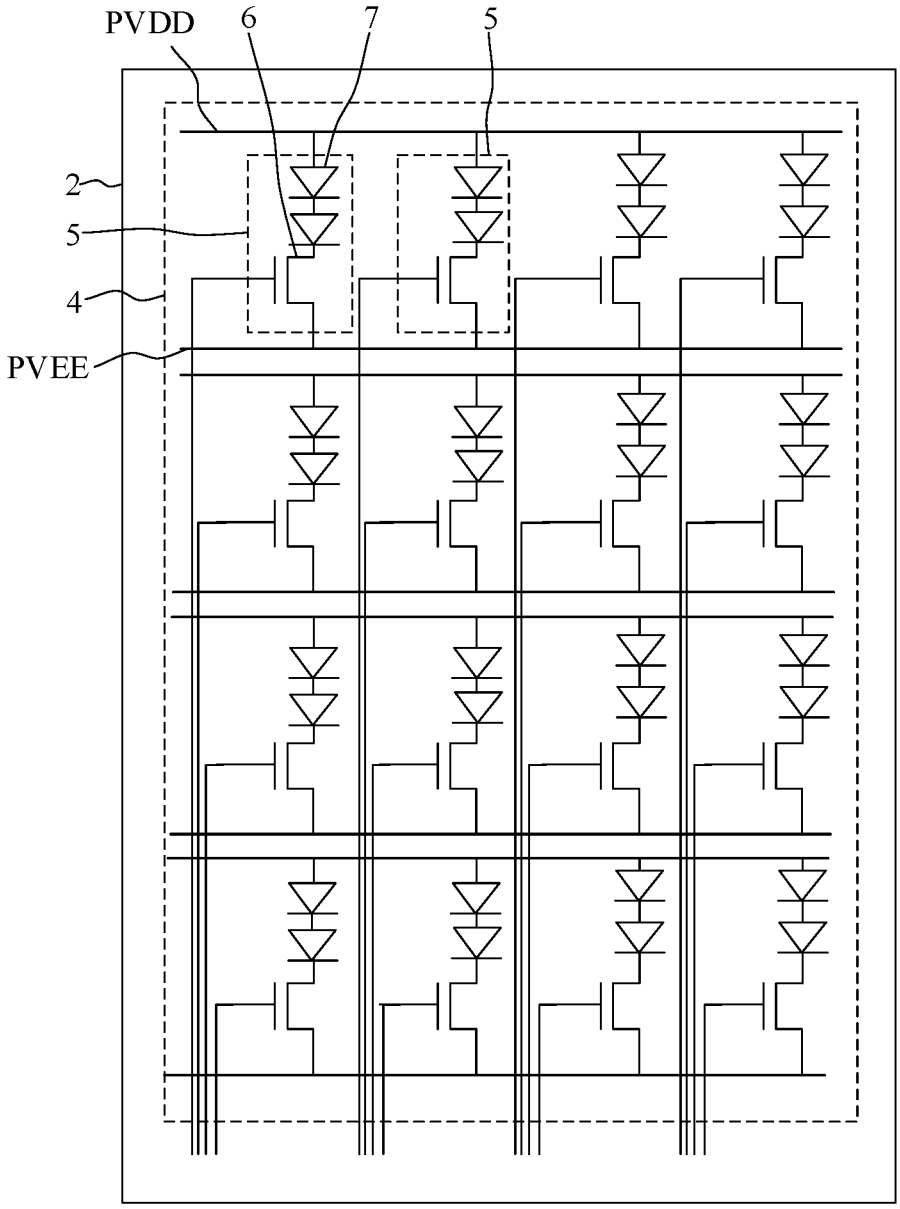
FIG. 17 is another schematic diagram of a structure of a backlight source according to an embodiment of the present disclosure.

In an embodiment, as shown in FIG. 17, which is another schematic diagram of a structure of a backlight source according to an embodiment of the present disclosure, each light-exiting sub-area 5 is provided with a same number of light-emitting diodes 7. For example, each light-exiting sub-area 5 is provided with only one light-emitting diode 7 or a plurality of light-emitting diodes 7 that is connected in series. It will be understood that the more light-emitting diodes 7 provided in each light-exiting sub-area 5 leads to the greater light-exiting brightness for the light-exiting sub-area 5. By providing each light-exiting sub-area 5 with a same number of light-emitting diodes 7, the light-exiting brightness for each light-exiting sub-area 5 can be more uniform.

In an embodiment, with further reference to FIG. 2, the switch 6 includes a thin film transistor 29 including a control electrode, a first electrode and a second electrode. The control electrode of the thin film transistor 29 is electrically connected to a control signal line 30, which is configured to receive the first pulse signal. The positive electrode of the light-emitting diode 7 is electrically connected to a first power supply signal line PVDD, and the negative electrode of the light-emitting diode 7 is electrically connected to the first electrode of the thin film transistor 29. The second electrode of the thin film transistor 29 is electrically connected to a second power supply signal line PVEE. Alternatively, the first electrode of the thin film transistor 29 is electrically connected to the first power supply signal line PVDD, the second electrode of the thin film transistor 29 is electrically connected to the positive electrode of the light-emitting diode 7, and the negative electrode of the light-emitting diode 7 is electrically connected to the second power supply signal line PVEE.

When the thin film transistor 29 is turned on under an action of an effective level of the first pulse signal, a signal transmission path between the first power supply signal line PVDD and the positive electrode of the light-emitting diode 7 or between the second power supply signal line PVEE and the negative electrode of the light-emitting diode 7 is turned on, so that the light-emitting diode 7 emits light under a difference between a voltage of the first power supply signal and a voltage of the second power supply signal, thereby achieving normal operation of the light-emitting diode 7.

Figure 18:
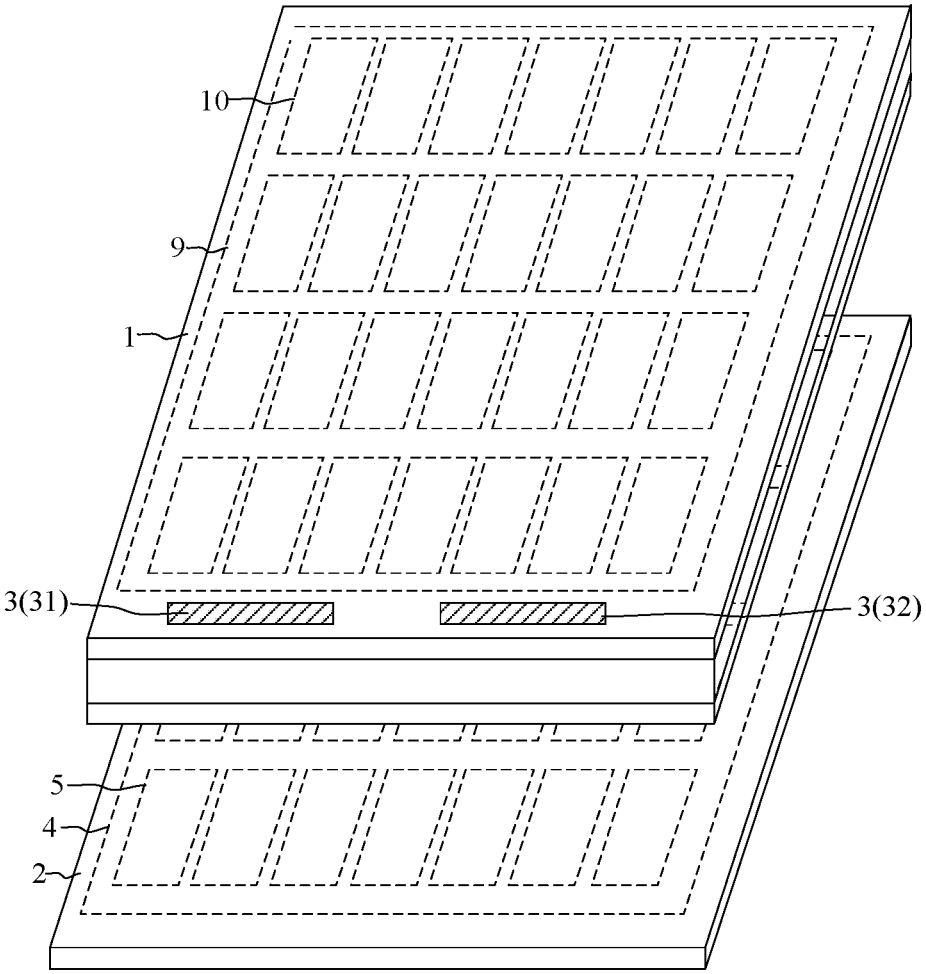
FIG. 18 is another schematic diagram of a structure of a display device according to an embodiment of the present disclosure.

In an embodiment, as shown in FIG. 18, which is another schematic diagram of a structure of a display device according to an embodiment of the present disclosure, the driving chip 3 includes a first sub-chip 31 and a second sub-chip 32. The backlight driving circuit 11 is provided on the first sub-chip 31, and the panel driving circuit 18 is provided on the second sub-chip 32. By separately providing the backlight driving circuit 11 and the panel driving circuit 18 on different sub-chips, driving of the backlight source 2 and the display panel 1 can be individually controlled, thereby improving reliability of implementation of the two functions.

While the preferred embodiments of the present disclosure have been described above, the scope of the present disclosure is not limited thereto. Various modifications, equivalent alternatives or improvements can be made by those skilled in the art without departing from the scope of the present disclosure. These modifications, equivalent alternatives and improvements are to be encompassed by the scope of the present disclosure.

What is claimed is:

1. A driving method for a display device, the display device comprising:

a display panel comprising a plurality of sub-pixels;

a backlight source located at a side of the display panel facing away from a light-exiting surface of the display device, wherein the backlight source has a light-exiting area comprising a plurality of light-exiting sub-areas, and each of the plurality of light-exiting sub-areas is provided with a switch and a light-emitting diode electrically connected to the switch; and a driving chip bonded to the display panel and configured to drive the plurality of sub-pixels and to drive the light-emitting diode of the backlight source to emit light, wherein the display panel is provided with gate lines and data lines, the gate lines intersect the data lines in an insulated way to define the plurality of sub-pixels, a display area of the display panel comprises a plurality of display sub-areas corresponding to the plurality of light-exiting sub-areas in one-to-one correspondence, and each of the plurality of display sub-areas is provided with at least one of the plurality of sub-pixels wherein the driving method comprises:

obtaining, by the driving chip, a theoretical brightness value of the light-emitting diode in each of the plurality of light-exiting sub-areas based on an image to be displayed on the display panel;

obtaining, by the driving chip, an actual brightness look-up table, searching the actual brightness look-up table for an actual brightness value closest to the theoretical brightness value, and setting the actual brightness value closest to the theoretical brightness value as a first brightness value;

generating, by the driving chip, a first pulse signal based on the first brightness value and outputting the first pulse signal to the switch in each of the plurality of light-exiting sub-areas, in such a manner that the switch controls, under driving of the first pulse signal, the light-emitting diode to emit light under an action of a first power supply signal and a second power supply signal;

obtaining, by the driving chip, a second brightness value corresponding to each of the plurality of sub-pixels based on the image to be displayed on the display panel and the first brightness value, generating a second pulse signal based on the second brightness value, and outputting the second pulse signal to the data lines for driving the plurality of sub-pixels to emit light, wherein said obtaining the theoretical brightness value of the light-emitting diode in each of the plurality of light-exiting sub-areas based on the image to be displayed on the display panel comprises:

obtaining a display grayscale corresponding to each of the plurality of sub-pixels based on the image to be displayed on the display panel, and calculating a maximum grayscale and an average grayscale corresponding to each of the plurality of display sub-areas;

calculating a theoretical grayscale corresponding to the light-emitting diode in each of the plurality of light-exiting sub-areas based on the maximum grayscale and the average grayscale corresponding to each of the plurality of display sub-areas; and obtaining the theoretical brightness value corresponding to the theoretical grayscale based on a pre-stored grayscale-brightness mapping relationship look-up table; and wherein said obtaining the display grayscale corresponding to each of the plurality of sub-pixels based on the image to be displayed on the display panel and calculating the maximum grayscale and the average grayscale corresponding to each of the plurality of display sub-areas comprises:

obtaining the display grayscale corresponding to each of the plurality of sub-pixels based on the image to be displayed on the display panel;

calculating the maximum grayscale $C_{_max}$ corresponding to each of the plurality of display sub-areas based on $C_{_max}=\Sigma_{i=0}^{255}A_i\times i$, where $A_i$ denotes a number of sub-pixels with a display grayscale of i in the display sub-area; and calculating the average grayscale $C_{_average}$ corresponding to each of the plurality of display sub-areas based on $$C_{_average}=\frac{C_{_max}}{m},$$

where m denotes a number of sub-pixels in the display sub-area, wherein said calculating the theoretical grayscale corresponding to the light-emitting diode in each of the plurality of light-exiting sub-areas based on the maximum grayscale and the average grayscale corresponding to each display sub-area comprises: calculating the theoretical grayscale $C_{_LED}'$ corresponding to the light-emitting diode in each of the plurality of light-exiting sub-areas based on $C_{_LED}'=C_{_max}\times rate+C_{_average}\times(1-rate)$, where $0\leq rate\leq 1$.

2. The driving method according to claim 1, wherein said obtaining the actual brightness look-up table comprises: obtaining, based on pulse signals each having one of all duty ratios outputted by the driving chip, different actual brightness values of light emitted by the light-emitting diode when the switch controls the light-emitting diode to emit light under driving of the pulse signals having different duty ratios, and building the actual brightness look-up table based on the actual brightness values.

3. The driving method according to claim 1, wherein said searching the actual brightness look-up table for the actual brightness value closest to the theoretical brightness value and setting the actual brightness value closest to the theoretical brightness value as the first brightness value comprise:

calculating a difference between each actual brightness value contained in the actual brightness look-up table and the theoretical brightness value; and comparing the difference to determine a minimum difference, and setting the actual brightness value corresponding to the minimum difference as the first brightness value, wherein when two different actual brightness values are determined to correspond to the minimum difference, the smaller one of the two different actual brightness values is set as the first brightness value.

4. A driving method for a display device, the display device comprising:

a display panel comprising a plurality of sub-pixels;

a backlight source located at a side of the display panel facing away from a light-exiting surface of the display device, wherein the backlight source has a light-exiting area comprising a plurality of light-exiting sub-areas, and each of the plurality of light-exiting sub-areas is provided with a switch and a light-emitting diode electrically connected to the switch; and a driving chip bonded to the display panel and configured to drive the plurality of sub-pixels and to drive the light-emitting diode of the backlight source to emit light, wherein the display panel is provided with gate lines and data lines, the gate lines intersect the data lines in an insulated way to define the plurality of sub-pixels, a display area of the display panel comprises a plurality of display sub-areas corresponding to the plurality of light-exiting sub-areas in one-to-one correspondence, and each of the plurality of display sub-areas is provided with at least one of the plurality of sub-pixels;

wherein the driving method comprises:

obtaining, by the driving chip, a theoretical brightness value of the light-emitting diode in each of the plurality of light-exiting sub-areas based on an image to be displayed on the display panel;

obtaining, by the driving chip, an actual brightness look-up table, searching the actual brightness look-up table for an actual brightness value closest to the theoretical brightness value, and setting the actual brightness value closest to the theoretical brightness value as a first brightness value;

generating, by the driving chip, a first pulse signal based on the first brightness value and outputting the first pulse signal to the switch in each of the plurality of light-exiting sub-areas, in such a manner that the switch controls, under driving of the first pulse signal, the light-emitting diode to emit light under an action of a first power supply signal and a second power supply signal; and obtaining, by the driving chip, a second brightness value corresponding to each of the plurality of sub-pixels based on the image to be displayed on the display panel and the first brightness value, generating a second pulse signal based on the second brightness value, and outputting the second pulse signal to the data lines for driving the plurality of sub-pixels to emit light;

wherein said obtaining the second brightness value corresponding to each sub-pixel based on the image to be displayed on the display panel and the first brightness value comprises:

obtaining the display grayscale corresponding to each sub-pixel based on the image to be displayed on the display panel; and calculating the second brightness value $L_{_pixel}$ corresponding to each of the plurality of sub-pixels based on $$L_{_LED}\times\frac{L_{_pixel}}{i}\times\gamma=L_{_LED1}\times\frac{L_{_pixel_1}}{i}\times\gamma,$$

where, γ denotes a gamma coefficient, $L_{_LED}$ denotes the first brightness value, $L_{_LED1}$ denotes a maximum light-emitting brightness value of the light-emitting diode when continuously emitting light in one frame, and $L_{_pixel_1}$ denotes a theoretical light-emitting brightness value of the sub-pixel at the display grayscale of i.

5. The driving method according to claim 1, wherein the plurality of light-exiting sub-areas comprises a first light-exiting sub-area and a second light-exiting sub-area, and the first brightness value corresponding to the first light-exiting sub-area is greater than the first brightness value corresponding to the second light-exiting sub-area; and the first pulse signal corresponding to the first light-exiting sub-area has a greater duty ratio than the first pulse signal corresponding to the second light-exiting sub-area.

6. The driving method according to claim 1, wherein the plurality of light-exiting sub-areas comprises a first light-exiting sub-area and a second light-exiting sub-area, and the first brightness value corresponding to the first light-exiting sub-area is greater than the first brightness value corresponding to the second light-exiting sub-area; and a duration during which the first pulse signal is outputted to the switch in the first light-exiting sub-area is longer than a duration during which the first pulse signal is outputted to the switch in the second light-exiting sub-area.

7. The driving method according to claim 1, wherein a voltage of the first power supply signal is greater than a threshold voltage of the light-emitting diode.

8. A display device, comprising:

a display panel comprising a plurality of sub-pixels;

a backlight source located at a side of the display panel facing away from a light-exiting surface of the display device, wherein the backlight source has a light-exiting area comprising a plurality of light-exiting sub-areas, and each of the plurality of light-exiting sub-areas is provided with a switch and a light-emitting diode electrically connected to the switch; and a driving chip bonded to the display panel and configured to drive the plurality of sub-pixels and to drive the light-emitting diode of the backlight source to emit light, the driving chip comprising a backlight driving circuit, the backlight driving circuit comprising a theoretical brightness obtaining module, a first brightness setting module, and a backlight controlling module, wherein the theoretical brightness obtaining module is configured to obtain a theoretical brightness value of the light-emitting diode in each of the plurality of light-exiting sub-areas based on an image to be displayed on the display panel;

the first brightness setting module is electrically connected to the theoretical brightness obtaining module, and is configured to obtain an actual brightness look-up table, which is searched for an actual brightness value closest to the theoretical brightness value, and the actual brightness value closest to the theoretical brightness value is set as a first brightness value; and the backlight controlling module is electrically connected to the first brightness setting module, and is configured to generate a first pulse signal based on the first brightness value and output the first pulse signal to the switch in each of the plurality of light-exiting sub-areas, in such a manner that the switch controls, under driving of the first pulse signal, the light-emitting diode to emit light under an action of a first power supply signal and a second power supply signal;

wherein the display panel is provided with gate lines and data lines, and the gate lines intersect the data lines in an insulated way to define the plurality of sub-pixels; and a display area of the display panel comprises a plurality of display sub-areas corresponding to the plurality of light-exiting sub-areas in one-to-one correspondence, and each of the plurality of display sub-areas is provided with at least one of the plurality of sub-pixels;

the driving chip further comprises a panel driving circuit, and the panel driving circuit comprises a second brightness setting module and a panel controlling module;

the second brightness setting module is electrically connected to the first brightness setting module, and is configured to obtain a second brightness value corresponding to each of the plurality of sub-pixels based on the image to be displayed on the display panel and the first brightness value; and the panel controlling module is electrically connected to the second brightness setting module, and is configured to generate a second pulse signal based on the second brightness value and output the second pulse signal to the data lines for driving the of the plurality of sub-pixels to emit light;

wherein the theoretical brightness obtaining module comprises:

a maximum and average grayscales calculating sub-module configured to obtain a display grayscale corresponding to each of the plurality of sub-pixels based on the image to be displayed on the display panel, and calculate a maximum grayscale and an average grayscale corresponding to each of the plurality of display sub-areas;

a theoretical grayscale obtaining sub-module electrically connected to the maximum and average grayscales calculating sub-module and configured to calculate a theoretical grayscale corresponding to the light-emitting diode in each of the plurality of light-exiting sub-areas based on the maximum grayscale and the average grayscale corresponding to each of the plurality of display sub-areas; and a theoretical brightness obtaining sub-module electrically connected to the theoretical grayscale obtaining sub-module and the first brightness setting module and configured to obtain the theoretical brightness value corresponding to the theoretical grayscale based on a pre-stored grayscale-brightness mapping relationship look-up table; and wherein the maximum and average grayscales calculating sub-module comprises:

a display grayscale obtaining unit configured to obtain the display grayscale corresponding to each of the plurality of sub-pixels based on the image to be displayed on the display panel;

a maximum grayscale calculating unit electrically connected to the display grayscale obtaining unit and the theoretical grayscale obtaining sub-module and configured to calculate the maximum grayscale $C_{_max}$ corresponding to each of the plurality of display sub-areas based on $C_{_max}=\Sigma_{i=0}^{255}A_i\times i$, where $A_i$ denotes a number of sub-pixels with a grayscale of i in the display sub-area; and an average grayscale calculating unit electrically connected to the maximum grayscale calculating unit and the theoretical grayscale obtaining sub-module and configured to calculate the average grayscale $C_{_average}$ corresponding to each display sub-area based on $$C_{_average} = \frac{C_{_max}}{m},$$

where m denotes a number of sub-pixels in the display sub-area, wherein the theoretical grayscale obtaining sub-module is configured to calculate the theoretical grayscale $C_{_LED}'$ corresponding to the light-emitting diode in each of the plurality of light-exiting sub-areas based on $C_{_LED}'=C_{_max}\times rate+C_{_average}\times(1-rate)$, where $0\leq rate\leq 1$.

9. The display device according to claim 8, wherein the first brightness setting module comprises:

an actual brightness table building sub-module configured to obtain different actual brightness values of light emitted by the light-emitting diode when the switch controls the light-emitting diode to emit light under driving of pulse signals having different duty ratios, and configured to build the actual brightness look-up table based on the actual brightness values;

a difference calculating sub-module electrically connected to the theoretical brightness obtaining module and the actual brightness table building sub-module and configured to calculate a difference between each of the plurality of actual brightness values contained in the actual brightness look-up table and the theoretical brightness value; and a difference comparing sub-module electrically connected to the difference calculating sub-module and the backlight controlling module and configured to compare the differences to determine a minimum difference, and set the actual brightness value corresponding to the minimum difference as the first brightness value, wherein when two different actual brightness values are determined to correspond to the minimum difference, the smaller one of the two different actual brightness values is set as the first brightness value.

10. A display device, applying the driving method according to claim 4, wherein the driving chip comprises a backlight driving circuit, and the backlight driving circuit comprises a theoretical brightness obtaining module, a first brightness setting module, and a backlight controlling module, wherein the theoretical brightness obtaining module is configured to obtain a theoretical brightness value of the light-emitting diode in each of the plurality of light-exiting sub-areas based on an image to be displayed on the display panel;

the first brightness setting module is electrically connected to the theoretical brightness obtaining module, and is configured to obtain an actual brightness look-up table, which is searched for an actual brightness value closest to the theoretical brightness value, and the actual brightness value closest to the theoretical brightness value is set as a first brightness value; and the backlight controlling module is electrically connected to the first brightness setting module, and is configured to generate a first pulse signal based on the first brightness value and output the first pulse signal to the switch in each of the plurality of light-exiting sub-areas, in such a manner that the switch controls, under driving of the first pulse signal, the light-emitting diode to emit light under an action of a first power supply signal and a second power supply signal;

wherein the driving chip further comprises a panel driving circuit, and the panel driving circuit comprises a second brightness setting module and a panel controlling module;

the second brightness setting module is electrically connected to the first brightness setting module, and is configured to obtain a second brightness value corresponding to each of the plurality of sub-pixels based on the image to be displayed on the display panel and the first brightness value; and the panel controlling module is electrically connected to the second brightness setting module, and is configured to generate a second pulse signal based on the second brightness value and output the second pulse signal to the data lines for driving the of the plurality of sub-pixels to emit light;

wherein the second brightness setting module comprises:

a display grayscale obtaining sub-module configured to obtain the display grayscale corresponding to each of the plurality of sub-pixels based on the image to be displayed on the display panel; and a second brightness obtaining sub-module electrically connected to the display grayscale obtaining sub-module and the first brightness setting module and configured to calculate the second brightness value $L_{_pixel}$ corresponding to each sub-pixel based on $$L_{_LED}\times\frac{L_{_pixel}}{i}\times\gamma=L_{_LED1}\times\frac{L_{_pixel_1}}{i}\times\gamma,$$

where, $\gamma$ denotes a gamma coefficient, $L_{_LED}$ denotes the first brightness value, $L_{_LED1}$ denotes a maximum light-emitting brightness value of the light-emitting diode when continuously emitting light in one frame, and $L_{_pixel_1}$ denotes a theoretical light-emitting brightness value of the sub-pixel at the display grayscale of i.

11. The display device according to claim 8, wherein each of the plurality of light-exiting sub-areas is provided with a same number of light-emitting diodes.

12. The display device according to claim 8, wherein the switch comprises a thin film transistor comprising a control electrode, a first electrode and a second electrode; the control electrode of the thin film transistor is electrically connected to a control signal line configured to receive the first pulse signal; and a positive electrode of the light-emitting diode is electrically connected to a first power supply signal line, a negative electrode of the light-emitting diode is electrically connected to the first electrode of the thin film transistor, and the second electrode of the thin film transistor is electrically connected to a second power supply signal line; or the first electrode of the thin film transistor is electrically connected to the first power supply signal line, the second electrode of the thin film transistor is electrically connected to the positive electrode of the light-emitting diode, and the negative electrode of the light-emitting diode is electrically connected to the second power supply signal line.

13. The display device according to claim 8, wherein the driving chip comprises a first sub-chip and a second sub-chip, the backlight driving circuit is provided on the first sub-chip, and the panel driving circuit is provided on the second sub-chip.

* * * * *